US011021931B1

(12) United States Patent
Arterbury et al.

(10) Patent No.: US 11,021,931 B1
(45) Date of Patent: Jun. 1, 2021

(54) SAND FALLBACK SUBMERSIBLE PUMP PROTECTION APPARATUS

(71) Applicants: Roy Spence Arterbury, Houston, TX (US); Michael Edwin Pollard, Houston, TX (US)

(72) Inventors: Roy Spence Arterbury, Houston, TX (US); Michael Edwin Pollard, Houston, TX (US)

(73) Assignee: THE CAVINS CORPORATION, Houston, TX (US)

( * ) Notice: Subject to any disclaimer, the term of this patent is extended or adjusted under 35 U.S.C. 154(b) by 0 days.

(21) Appl. No.: 16/694,337

(22) Filed: Nov. 25, 2019

(51) Int. Cl.
*E21B 34/08* (2006.01)
*E21B 43/12* (2006.01)

(52) U.S. Cl.
CPC ..... *E21B 34/08* (2013.01); *E21B 43/128* (2013.01); *E21B 2200/04* (2020.05)

(58) Field of Classification Search
CPC .... E21B 34/08; E21B 43/128; E21B 2200/04; E21B 33/00
See application file for complete search history.

(56) References Cited

U.S. PATENT DOCUMENTS 5,662,167 A * 9/1997 Patterson ..... B01D 21/0003 166/105.1
2017/0328190 A1* 11/2017 Fielder, III ..... E21B 43/128

FOREIGN PATENT DOCUMENTS

GB 2431677 A * 5/2007 ..... E21B 34/08
WO WO-2018052857 A1 * 3/2018 ..... E21B 43/128

* cited by examiner

*Primary Examiner* — James G Sayre
(74) *Attorney, Agent, or Firm* — Patrick K. Steele

(57) ABSTRACT

A sand fallback tool having an outer tubular body with proximal end, a distal end, a chamber therebetween surrounding an axis extending from the proximal end through the distal end, a tubular flow divider supported within the chamber to divide at least a portion of the chamber of the outer tubular body into a central passage along the axis and an annular passage radially intermediate an exterior of the tubular flow divider and an interior of the outer tubular body, and an unobstructed axial settling path from the proximal connector into the central passage. One embodiment further includes a tubular extension coupled to the proximal connector and extending along the axis to terminate at a distal end of the tubular extension received within a proximal end of the tubular flow divider to provide an "S"-shaped flow pathway intermediate the annular passage and the proximal connector of the outer tubular body.

20 Claims, 7 Drawing Sheets

SAND FALLBACK SUBMERSIBLE PUMP PROTECTION APPARATUS

BACKGROUND

Field of the Invention

The present invention relates to a sand fallback tool that provides protection against unwanted damage to or incapacitation of downhole submersible pumps used to recover formation fluids from subsurface geologic formations through artificial lift. The present invention is directed to a sand fallback tool that prevents sand from settling out of fluids standing in a stagnant production string back onto or into a submersible artificial lift pump. Unwanted sand intrusion into the submersible pump can damage or disable the submersible pump and prevent it from being successfully restarted for continued fluid production to the surface.

Background of the Related Art

Some subsurface geologic formations produce fluids with entrained sand. The sand can cause problems with production equipment. For example, entrained sand will settle from the fluid in which it is entrained upon interruption of a submersible pump used to pump fluids entering a well from fluid-bearing subsurface geologic formations to the surface. This is called sand fallback. The settling sand can settle in an inactive submersible pump and clog or otherwise impair restoration of operation of the pump.

Sand fallback generally occurs when electrical current to a submersible pump is interrupted causing sand entrained in the fluid that was flowing up a production string at the time of the interruption to settle. Settling sand can enter and damage and/or obstruct restoration of the operation of the submersible pump rotors upon reactivation of the pump.

Some prior art sand fallback tools include movable components that are often connected through linkages or mechanisms one to the others. Such connected linkages and mechanisms may become clogged, obstructed or otherwise incapacitated by settling sand, thereby preventing smooth restoration of submersible pump operation and resumption of fluid production from the well.

One prior art sand fallback tool includes a tubular flow divider to divide a chamber within the sand fallback tool into a central passage and an annular passage, and a diverter disposed adjacent to a proximal connection that couples to a production string. The diverter causes sand settling back into the sand fallback tool during interruptions in the operation of the submersible pump to be diverted in the annular passage, thereby leaving the central passage open for restoration of fluid flow upon reactivation of the submersible pump. Settled sand is thereby accumulated and stored in the annular passage upon interruption of operation of the submersible pump coupled to a distal end of the sand fallback tool.

Sand fallback tools are generally elongate tools that are coupled to a submersible pump at a distal connector, coupled to the production string at a proximal connector, and positioned within a well in a vertical orientation so that sand settling out of fluid residing in a stagnant production string is prevented from settling into an inactive submersible pump coupled to the distal connector.

SUMMARY

Embodiments of the sand fallback tool of the present invention are adapted to be coupled to a distal end of a tubular production string and positioned in a well in a vertical orientation. Embodiments of the sand fallback tool include a distal end adapted for being coupled to a proximal end of a submersible pump, also known as an electrical submersible pump (ESP). Embodiments of the sand fall back tool of the present invention prevent settling sand from entering into the proximal end of a submersible pump coupled to the distal end of the sand fallback tool.

Some embodiments of the sand fallback tool of the present invention include movable components that are not physically connected to other movable or immovable components of the tool, but are instead dynamically displaceable by fluid flow within a cage, channel or a chamber in which the movable component can move. Some embodiments of the sand fallback tool of the present invention include one or more check valves that open to allow the flow of fluid, with sand entrained therein, through the sand fallback tool and upwardly into a production tubing through which the fluid flows to the surface during operation of a submersible pump. These check valves will later close to prevent unwanted backflow of fluid and unwanted settling of sand into the submersible pump that is coupled to the distal end of the sand fallback tool when the submersible pump may become inactive.

Embodiments of the sand fallback tool of the present invention include a proximal end with a threaded proximal connector for threadedly coupling the sand fallback tool to a distal end of a tubular string that can be stepwise extended into an earthen well to position and support the sand fallback tool and a submersible pump coupled thereto, and a distal end with a threaded distal connector for threadedly coupling to a proximal end (discharge end) of a submersible pump. "Coupling," as that term is used herein, means that the production tubing and the sand fallback tool, or the sand fallback tool and the submersible pump, may be directly coupled, and it also means that other tools may be coupled intermediate the proximal end of the sand fallback tool and the production tubing or between the distal end of the sand fallback tool and the submersible pump without loss of benefit and use of the sand fallback tool. More than one sand fallback tool can be included within the same tool string for enhanced protection against unwanted sand entry into the submersible pump.

The distal connector of embodiments of the sand fallback tool has a bore for the upwardly passage of fluids entering the sand fallback tool from the submersible pump coupled to the distal connector. The proximal connector of embodiments of the sand fallback tool has a bore for passage of fluids exiting the sand fallback tool to then enter a production tubing coupled to the proximal connector of the sand fallback tool. Embodiments of the sand fallback tool include a central chamber that is aligned with the proximal connector of the sand fallback tool and that can receive and store settling sand without obstruction or closing of an annular passage that surrounds the central chamber. The annular passage can, when the central passage is obstructed with settled sand, provide a fluid flow passage to bypass the obstructed central passage and allow the submersible pump to be restarted and operated until the settled sand obstruction can be cleared from the central passage.

DETAILED DESCRIPTION

Embodiments of the sand fallback tool of the present invention provide a substantial amount of storage and retention space for settled sand so that the settled sand does not enter and possible clog or otherwise disable a submersible pump coupled to the distal end of the sand fallback tool. Embodiments of the sand fallback tool include an unobstructed axial settling path from a proximal connector of the tool downwardly into a central passage of the tool within the tubular flow divider. The advantages of this structure will be apparent from the discussion that follows.

Figure 1:
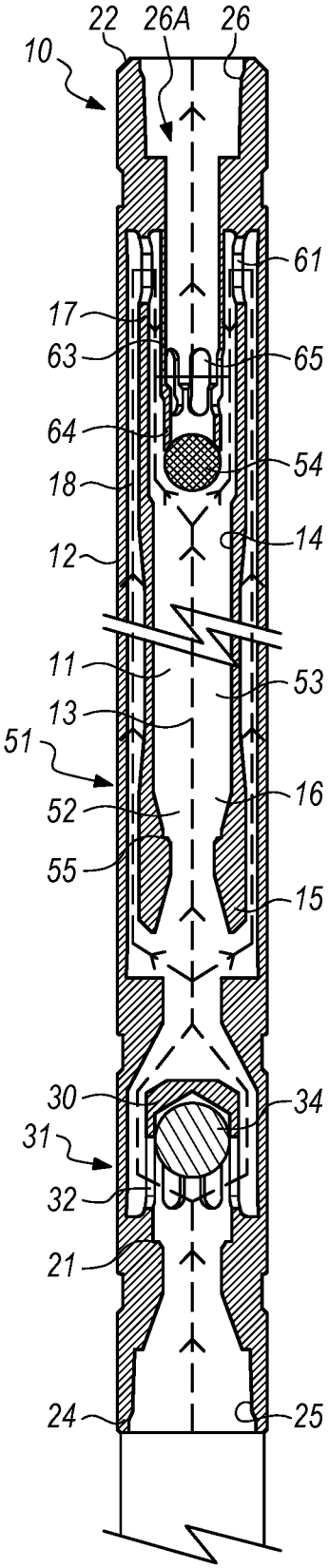
FIG. 1 is a cross-sectional elevation view of an embodiment of the sand fallback tool of the present invention.

FIG. 1 is a cross-sectional elevation view of an embodiment of the sand fallback tool 10 of the present invention. The sand fallback tool 10 of FIG. 1 comprises an elongate outer tubular body 12 having a proximal end 22 with a proximal connector 26 for coupling the sand fallback tool 10 to a string of production tubing (not shown), a distal end 24 with a distal connector 25 for coupling to a submersible pump (not shown), and a chamber 11 within the outer tubular body 12 axially between the proximal connector 26 and the distal connector 25. The chamber 11 within the outer tubular body 12 is divided into portions by a tubular flow divider 14 having a distal end 15, a central passage 16 within the tubular flow divider 14, and a proximal end 17. The tubular flow divider 14 of the sand fallback tool 10 of FIG. 1 is supported within the chamber 11 of the outer tubular body 12 centrally about the axis 13 to divide the portion of the chamber 11 in which the tubular flow divider 14 is supported into two flow passages through which fluid entering the distal connector 25 may flow to and through the proximal connector 26. The two flow passages include a central passage 16 disposed within the flow divider 14 and surrounding the axis 13 and the annular passage 18 radially intermediate the tubular flow divider 14 and the outer tubular body 12. The tubular flow divider 14 of the embodiment of the sand fallback tool 10 of FIG. 1 is supported within the chamber 11 of the outer tubular body 12 from the proximal end 17 of the tubular flow divider 14, but may in other embodiments be supported from the distal end 15 or from some other location along the tubular flow divider 14.

The embodiment of the sand fallback tool 10 of FIG. 1 further includes a distal check valve 31 having a cage 30 disposed within the chamber 11 of the outer tubular body 12 proximal to the distal connector 25 and a flow stop member 34 movably captured within the cage 30. The cage 30 of the distal check valve 31 includes a plurality of holes 32 through which fluid entering the chamber 11 through the distal connector 25 flows with the distal check valve 31 in the open position illustrated in FIG. 1. The distal check valve 31 of FIG. 1 further includes a seat 21 disposed within the chamber 11 of the outer tubular body 12, the seat 21 sized for sealed engagement with the flow stop member 34. FIG. 1 illustrates an embodiment of a sand fallback tool 10 having a distal check valve 31 that includes a flow stop member 34 that is spherical in shape, but in other embodiments of the sand fallback tool 10 of the present invention the flow stop member 34 may be an elongate plug with a tapered nose, such as a conical shape, or any other shape that can maintain a proper orientation within the cage 30 and then sealably engage the seat 21 of the distal check valve 31 upon closure to prevent unwanted fluid flow or settling sand to pass from the chamber 11 through the distal connector 25 and into a submersible pump (not shown) coupled to the distal connector 25 during interruptions of operation of the submersible pump. The flow stop member 34 may be of a material for providing to the flow stop member 34 a combination of density and surface friction to fluid flow there around so that the flow stop member 34 sinks to engage the seat 21 upon termination of operation of the submersible pump (not shown) coupled to the distal connector 25 and the flow stop member 34 is displaced upwardly and off of the seat 21 by application of fluid pressure and fluid flow entering the chamber 11 through the distal connector 25 during operation of the submersible pump.

The central passage 16 of the tubular flow divider 14 of the embodiment of the sand fallback tool 10 of FIG. 1 further includes a distal necked portion 52 proximal to the distal end 15 of the tubular flow divider 14 that is smaller in size than an adjacent portion 53 of the central passage 16. The central passage 16 includes a proximal check valve 51 including the distal necked portion 52 and a proximal flow stop member 54 within the central passage 16. The proximal check valve 51 is illustrated in FIG. 1 in the open position to allow fluid flow to pass upwardly through the central passage 16 and around the proximal flow stop member 54 of the proximal check valve 51. The proximal check valve 51 further includes a seat 55 within the distal necked portion 52 of the central passage 16 of the tubular flow divider 14, the seat 55 being shaped for sealed engagement with the proximal flow stop member 54 with the proximal check valve 51 in the closed position. As with the distal check valve 31, the proximal flow stop member 54 engages the seat 55 to prevent fluid and settled sand from flowing from the central passage 16 through the distal end 15 of the tubular flow divider 14. The embodiment of the sand fallback tool 10 of FIG. 1 further includes a tubular extension 63 coupled to the proximal connector 26 of the outer tubular body 12 and extending distally into the chamber 11 and into the central passage 16 of the tubular flow divider 14 to dispose a distal end 64 of the tubular extension 63 within the proximal end 17 of the tubular flow divider 14 and within the central passage 16. The distal end 64 of the tubular extension 63 serves to limit the range of movement of the proximal flow stop member 54 within the central passage 16 when the proximal flow stop member 54 is displaced from the seat 55 by fluid pressure applied to the proximal flow stop member 54 by operation of the submersible pump (not shown) coupled to the distal connector 25 of the sand fallback tool 10. The tubular extension 63 and the tubular flow divider 16 cause fluid flowing upwardly within the annular passage 18 to flow through an "S"-shaped pathway defined by the distal end 64 of the tubular extension 63 and the proximal end 17 of the tubular flow divider 14 into which the distal end 64 is disposed. During operation of the sand fallback tool 10, fluid moves within the annular passage 18 upwardly towards the proximal end 22 of the outer tubular body 12 to the proximal end 17 of the tubular flow divider 14, then radially inwardly through the holes 61 adjacent to the proximal end 17 of the tubular flow divider 14, then downwardly between the tubular extension 63 and the tubular flow divider 14 to the holes 65 within the tubular extension 63, and then radially inwardly into the tubular extension 63 to commingle with fluid flowing upwardly from the central passage 16 (if any) of the tubular flow divider 14 and then from the sand fallback tool 10 through the proximal connector 26. The tubular extension 63 extends a bore 26A of the proximal connector 26 downwardly into the proximal end 17 of the tubular flow divider 14. This structure substantially prevents settling sand that may enter the sand fallback tool 10 through the proximal connector 26 during interruptions of operation of the submersible pump (not shown), and causes sand to settle within the central passage 16 of the tubular flow divider 14 instead of settling within the annular passage 18, as will be discussed in more detail in connection with FIG. 2.

Figure 2:
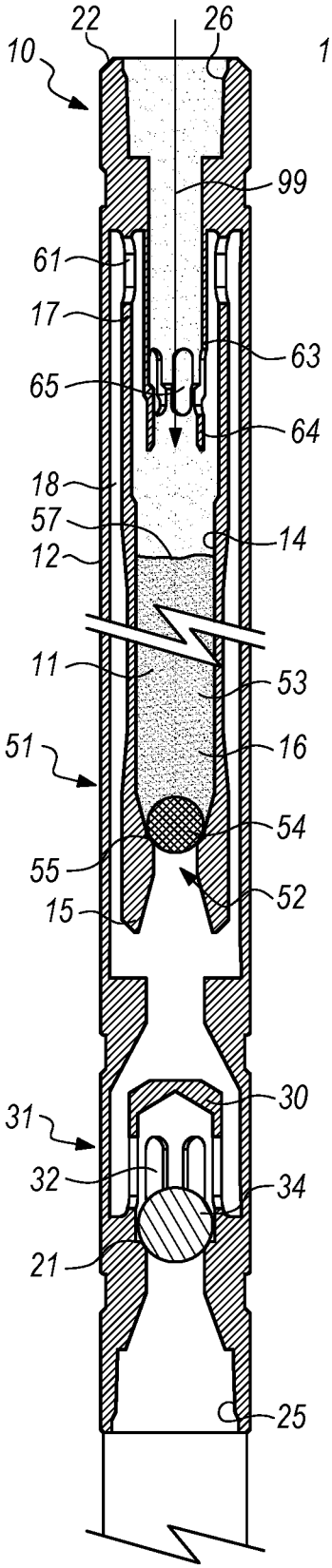
FIG. 2 is the cross-sectional elevation view of the embodiment of the sand fallback tool of FIG. 1 after interruption of the power supply to the submersible pump (not shown) and after settling sand has settled from the stagnant fluid in the production tubing (not shown) above the tool through the proximal connector and into the central passage of the tool to accumulate on the flow stop member of the check valve therewithin.

FIG. 2 is the cross-sectional elevation view of the embodiment of the sand fallback tool 10 of FIG. 1 after interruption of a power supply to the submersible pump (not shown) that moves fluid upwardly through the sand fallback tool 10 and after an amount of settling sand 57 has settled from a now-stagnant column of produced fluid residing in a string of production tubing (not shown) coupled to the proximal connector 26 and disposed above the sand fallback tool 10. As described above, the proximal flow stop member 54 of the proximal check valve 51 engages the seat 55 of the proximal check valve 51 upon interruption of the power supply and the distal flow stop member 34 of the distal check valve 31 engages the seat 21 of the distal check valve 31 due to the density of the proximal flow stop member 54 and the distal flow stop member 34 being greater than the density of the fluid produced through the sand fallback tool 10. FIG. 2 shows the settled sand 57 that settles downwardly from the production tubing and that enters the sand fallback tool 10 through the proximal connector 26, then through the tubular extension 63 extending downwardly therefrom, and into the central passage 16 of the tubular flow divider 14 to accumulate within the central passage 16 and atop the proximal flow stop member 54 engaged with the seat 55 of the proximal check valve 51. There is an unobstructed axial settling path 99 from the proximal connection 26 into the central passage 16 of tubular divider 14 that is supported within the chamber 11 of the outer tubular body 12. The unobstructed axial settling path 99 permits settling sand 57 to accumulate within the central passage 16 without blocking the annular passage 18, thereby permitting at least some fluid flow upon restoration of electrical power to the submersible pump that moves fluid upwardly through the sand fallback tool 10. The fluid flow provided by maintaining a clear annular passage 18 enables well production to be restored without damaging the submersible pump, which can be damaged by operation of the pump without some minimal amount of fluid throughput.

As illustrated in FIG. 2, the annular passage 18 remains open and unobstructed by settled sand 57 due to the alignment of the central passage 16 of the tubular flow divider 14 with the tubular extension 63 and the distal end 64 of the tubular extension 63 being disposed below the proximal end 17 of the tubular flow divider 14 to create the "S"-shaped flowpath. The sizes of the tubular extension 63 and the central passage 16 into which the tubular extension 63 extends can be selected to provide a desired pressure drop resisting the flow of fluid up the annular passage 18 of the sand fallback tool 10 so that there is a pressure differential from the annular passage 18 into the central passage 16 of the tubular flow divider 14. In some embodiments of the sand fallback tool 10 of the present invention, such as the one discussed below in relation to FIGS. 7-9, this pressure differential provides for leakage of pressurized fluid from the annular passage 18 through one or more apertures in tubular flow divider 14 into the central passage 16 of the tubular flow divider 14 to unsettle and/or fluidize an otherwise stagnant column of settled sand 57 therein. Upon removal of the sand fallback tool 10 from a well to the surface, apertures in the tubular flow divider 14 may also serve to relieve pressurized pockets of gas that may become trapped in the settled sand 57 that accumulates within the central passage 16 of the tubular flow divider 14. Embodiments of the present invention of the sand fallback tool 10 having one or more apertures in the tubular flow divider 14 are discussed in greater detail below in connection with FIGS. 7-9.

Figure 3:
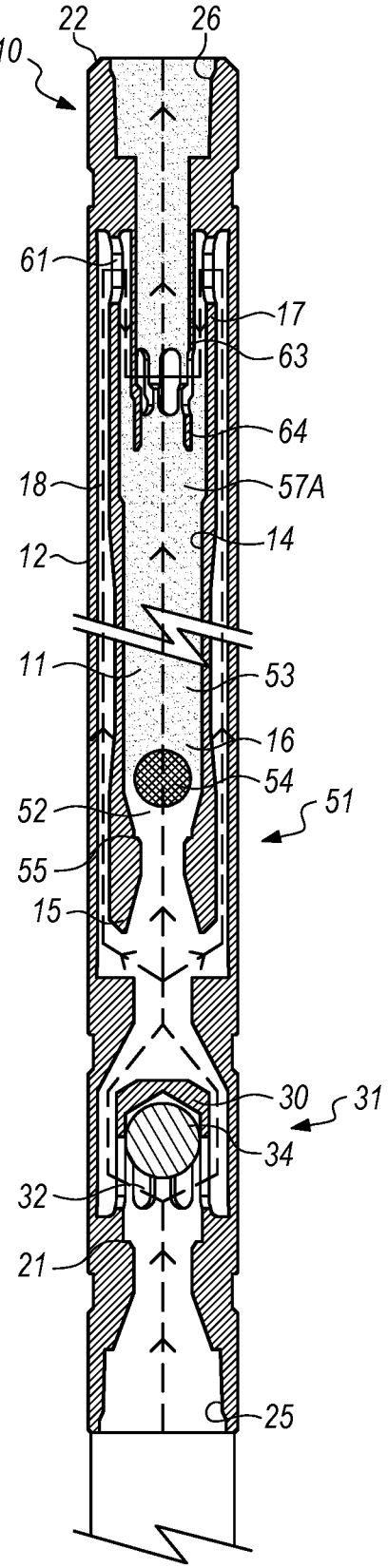
FIG. 3 is the cross-sectional elevation view of an embodiment of the sand fallback tool of FIGS. 1 and 2 after restoration of power to the submersible pump and resumption of fluid flow upwardly through the tool.

FIG. 3 is the cross-sectional elevation view of the embodiment of the sand fallback tool 10 of FIGS. 1 and 2 after restoration of power to the submersible pump (not shown) coupled to the distal connector 25 of the sand fallback tool 10 and resumption of fluid flow upwardly through the sand fallback tool 10. Upon restoration of the operation of the submersible pump, fluid pressure initially bears against and displaces the flow stop member 34 of the distal check valve 31 from the seat 21 to provide fluid flow from the submersible pump, through the distal connector 25, through the holes 32 of the cage 30 of the distal check valve 31, through the annular passage 18, through the "S"-shaped flow path formed by the tubular extender 63 and the proximal end 17 of the tubular flow divider 14, through the holes 65 in the tubular extension 63 to exit from the sand fallback tool 10 by way of the proximal connector 26. As flow through this fluid flow path defined by these structures occurs, the turbulence of the fluid flow causes unsettling and fluidization of the column of settled sand 57 within the central passage 16. At first, small amounts of the settled sand 57 begin to become entrained in the fluid flow emerging from the annular passage 18 and leaving the sand fallback tool 10 through the proximal connector 26. As the column lightens, fluid pressure bearing against the flow stop member 54 of the proximal check valve 51 eventually displaces the flow stop body 54 from the seat 55 and fluid begins to flow into the distal end 15 of the tubular flow divider 14, around the flow stop member 54 and through the column of settled sand 57, thereby further entraining sand in the fluid flow exiting the sand fallback tool 10 at the proximal connector 26.

Figures 4, 5, 6:
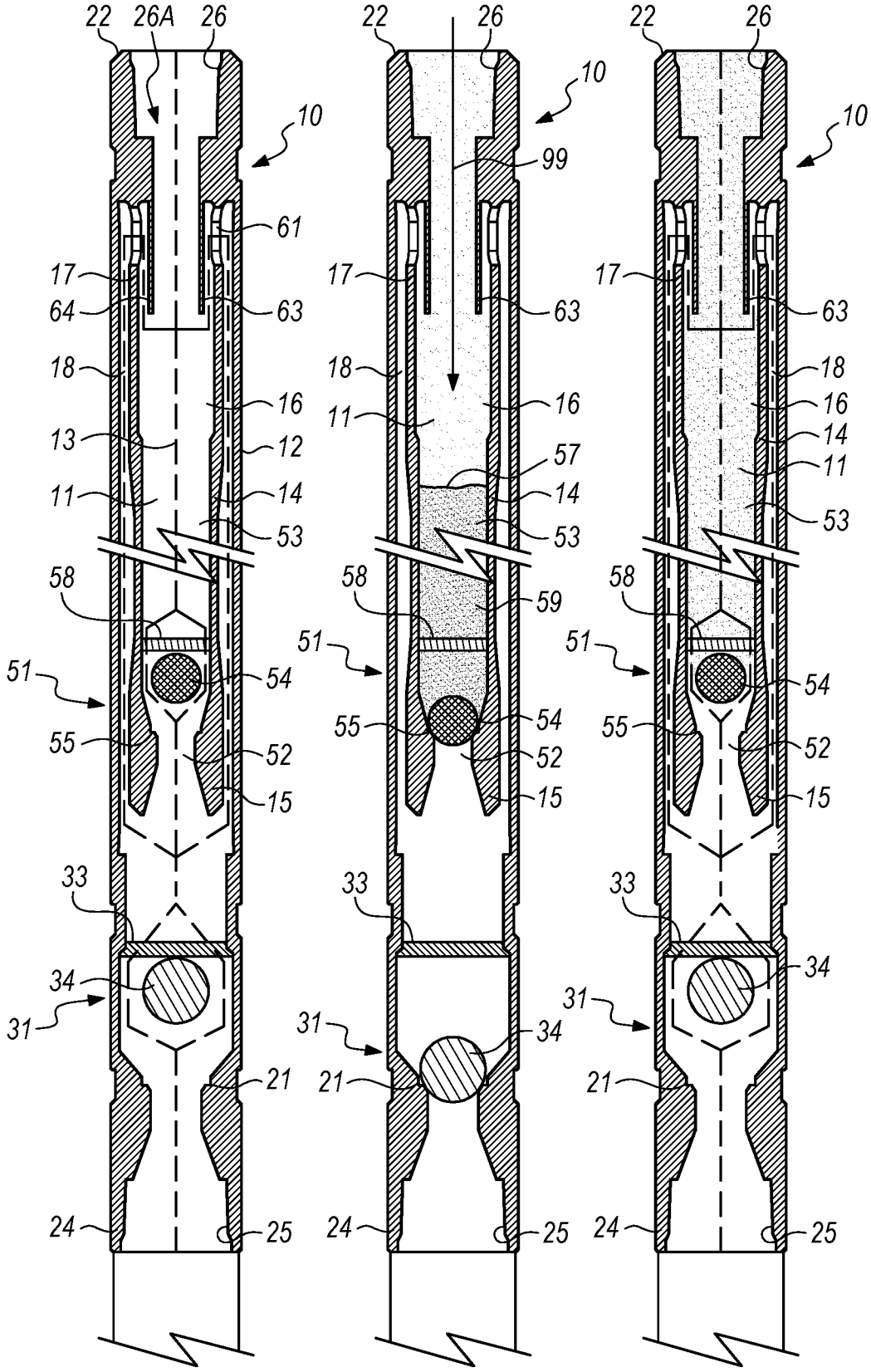
FIG. 4 is a cross-sectional elevation view of an alternate embodiment of the sand fallback tool of the present invention.
FIG. 5 is the cross-sectional elevation view of the embodiment of the sand fallback tool of FIG. 4 after interruption of the power supply to the submersible pump (not shown) and after settling sand has settled from the stagnant fluid in the production tubing (not shown) above the tool through the proximal connector and into the central passage of the tool to accumulate on the flow stop member of the check valve therewithin.
FIG. 6 is the cross-sectional elevation view of an embodiment of the sand fallback tool of FIGS. 4 and 5 after restoration of power to the submersible pump and resumption of fluid flow upwardly through the tool.

FIG. 4 is a cross-sectional elevation view of an alternate embodiment of the sand fallback tool 10 of the present invention. The alternate embodiment of the sand fallback tool 10 illustrated in FIGS. 4-6 resembles the embodiment of the sand fallback tool 10 of FIGS. 1-3 except that instead of using a cylindrical cage 30 to limit the movement of the flow stop member 34 of the distal check valve 31 as shown in FIGS. 1-3, the embodiment of the sand fallback tool 10 of FIGS. 4-6 includes an alternative type of cage that includes a larger portion of the chamber 11 from the seat 21 to a permeable divider 33 such as, for example, a grate having a plurality of holes in it, to limit the range of movement of the flow stop member 34 while allowing fluid to pass there through. The substitution of the permeable divider 33 shown in FIGS. 4-6 for the conventional cage 30 shown in FIGS. 1-3 does not impair the benefit provided by embodiments of the sand fallback tool 10 of the present invention. Similarly, the alternate embodiment of the sand fallback tool 10 illustrated in FIGS. 4-6 resembles the embodiment of the sand fallback tool 10 of FIGS. 1-3 except that instead of having holes 65 in the tubular extension 63 to permit continuing fluid flow into the tubular extension 63 when the flow stop member 54 of the proximal check valve 51 engages the distal end 64 of the tubular extension 63, as illustrated in FIG. 1, the tubular flow divider 14 of the embodiment of the sand fallback tool 10 of FIGS. 4-6 includes a permeable divider 58 to limit the movement of the flow stop member 54 of the proximal check valve 51 as shown in FIGS. 4-6, thereby making the holes 65 in the tubular extension 63 (as shown in FIG. 1) unnecessary because the flow stop member 54 of the proximal check valve 51 of the embodiment of the sand fallback tool 10 of FIG. 4 is prevented by the permeable divider 58 from engaging and closing the distal end 64 of the tubular extension 63 to fluid flow.

The sand fallback tool 10 of FIG. 4 further comprises an elongate outer tubular body 12 having a proximal end 22 with a proximal connector 26 for coupling the sand fallback tool 10 to production tubing (not shown), a distal end 24 with a distal connector 25 for coupling to a submersible pump (not shown), and a chamber 11 within the outer tubular body 12 between the proximal connector 26 and the distal connector 25. The chamber 11 within the outer tubular body 12 is divided into portions by a tubular flow divider 14 having a distal end 15, a central passage 16 within the tubular flow divider 14, and a proximal end 17. The tubular flow divider 14 of the sand fallback tool 10 of FIG. 4 is supported within the chamber 11 of the outer tubular body 12 centrally about the axis 13 to divide the portion of the chamber 11 in which the tubular flow divider 14 is supported into two flow passages through which fluid entering the distal connector 25 may flow to the proximal connector 26. The two flow passages include a central passage 16 disposed within the flow divider 14 and surrounding the axis 13 and the annular passage 18 radially intermediate the tubular flow divider 14 and the outer tubular body 12. As with the embodiment of FIGS. 1-3, the tubular flow divider 14 of the embodiment of the sand fallback tool 10 of FIG. 4-6 is supported within the chamber 11 of the outer tubular body 12 from the proximal end 17 of the tubular flow divider 14, but may in other embodiments be supported from the distal end 15 or from some other location along the tubular flow divider 14.

The sand fallback tool 10 of FIG. 4 further includes a distal check valve 31 having a permeable divider 33 disposed within the chamber 11 of the outer tubular body 12 proximal to the distal connector 25 and a flow stop member 34 movably captured below the permeable divider 33. The permeable divider 33 of the distal check valve 31 may include a plurality of holes or slots therein through which fluid entering the chamber 11 through the distal connector 25 flows with the distal check valve 31 in the open position illustrated in FIG. 4. The distal check valve 31 of FIG. 4 further includes a seat 21 disposed within the chamber 11 of the outer tubular body 12, the seat 21 sized for sealed engagement with the flow stop member 34 as discussed below in connection with FIG. 5. FIG. 4 illustrates a flow stop member 34 that is spherical in shape, but in other embodiments of the sand fallback tool 10 of the present invention, the flow stop member 34 can be an elongate plug with a tapered nose, a conical shape, or any other shape that can maintain proper orientation within the chamber 11 and then sealably engage the seat 21 of the distal check valve 31 to prevent unwanted fluid flow or sand passage from the central passage 16 through the distal connector 25 and into the submersible pump (not shown) connected thereto during interruptions of operation of the submersible pump. The flow stop member 34 may be of a material for providing to the flow stop member 34 a combination of size, weight and surface friction to be displaced from the seat 21 and to thereby permit fluid flow around the flow stop member 34 and in the upwardly direction through the permeable divider 33 so that the flow stop member 34 drops or settles within the central passage 16 to sealably engage the seat 21 upon termination of operation of the submersible pump (not shown), and the flow stop member 34 is displaced from the seat 21 by fluid pressure and flow of fluid entering the chamber 11 through the distal connector 25 during operation of the submersible pump.

The central passage 16 of the tubular flow divider 14 of the sand fallback tool 10 of FIG. 4 further includes a distal necked portion 52 proximal to the distal end 15 of the tubular flow divider 14 that is smaller in size than an adjacent portion 53 of the central passage 16 distal to the distal end 15 of the tubular flow divider 14. The central passage 16 proximal to the distal end 15 further includes a proximal check valve 51 including the distal necked portion 52 and a proximal flow stop member 54 movable within the central passage 16. The proximal check valve 51 further includes a seat 55 within the tubular flow divider 14 at or adjacent to the distal necked portion 52 that is shaped for sealed engagement with the proximal flow stop member 54. As with the distal check valve 31, the proximal flow stop member 54 of the proximal check valve 51 sealably engages the seat 55 to prevent fluid and settled sand from flowing downwardly from the central passage 16 through the distal end 15 of the tubular flow divider 14. The embodiment of the sand fallback tool 10 of FIG. 4 further includes a permeable divider 58 within the adjacent portion 53 of the central passage 16 to limit the movement of the flow stop member 54 within the central passage 16 during operation of the submersible pump. The sand fallback tool 10 of FIG. 4 further includes a tubular extension 63 coupled to the proximal connector 26 of the outer tubular body 12 and extending distally into the chamber 11 and into the proximal end 17 of the tubular flow divider 14. The distal end 64 of the tubular extension 63 is disposed within the central passage 16. The tubular extension 63 and the tubular flow divider 14 cause fluid flowing within the annular passage 18 to flow through an "S"-shaped pathway disposed at the proximal end 17 of the flow passage divider 14 and along the tubular extension 63 as described above in relation to FIGS. 1-3. Upon restoration of the operation of the submersible pump, the flow of fluid within the annular passage 18 during operation of the submersible pump (not shown) coupled to the distal connector 25 flows upwardly through the distal connector 25, through the annular passage 18 to the proximal end 17 of the tubular flow divider 14, passes radially inwardly through the holes 61 therein, flows downwardly along the tubular extension 63 and then radially inwardly into the distal end 64 of the tubular extension 63 to mix with fluid flowing from the central passage 16 (if any) and then the fluid exits from the sand fallback tool 10 through the proximal connector 26. The tubular extension 63 extends the bore 26A of the proximal connector 26 downwardly into the central passage 16 of the tubular flow divider 14. This arrangement causes settling sand 57 that may enter the sand fallback tool 10 through the proximal connector 26 to settle within the central passage 16 of the tubular flow divider 14 instead of settling within the annular passage 18, as will be discussed in more detail in connection with FIG. 5.

FIG. 5 is the cross-sectional elevation view of the embodiment of the sand fallback tool 10 of FIG. 4 after interruption of the power supply to the submersible pump (not shown) and after settling sand 57 has settled from the stagnant fluid in the production tubing (not shown) above the sand fallback tool 10 through the proximal connector 26, through the tubular extension 63 and into the central passage 16 of the sand fallback tool 10 to accumulate a column 59 of settled sand 57 atop the flow stop member 54 of the proximal check valve 51, which is shown in the closed position. There is an unobstructed axial settling path 99 from the proximal connection 26 into the central passage 16 of tubular divider 14 that is supported within the chamber 11 of the outer tubular body 12. It can be seen in FIG. 5 how the settled sand 57 has settled through the permeable divider 58 (or grate) that limits movement of the flow stop member 54 and onto the seated flow stop member 54 as it sealably engages the seat 55. The tubular extension 63 of the embodiment of the sand fallback tool 10 of FIGS. 4-6 does not contain holes 65 as does the embodiment of the sand fallback tool 10 of FIG. 1-3 because the divider 58 prevents the flow stop member 54 from engaging and obstructing fluid flow into the tubular extension 63.

FIG. 6 is the cross-sectional elevation view of an embodiment of the sand fallback tool 10 of FIGS. 4 and 5 after restoration of power to the submersible pump (not shown) and resumption of fluid flow upwardly through the sand fallback tool 10. Pressurized fluid is pumped into the distal connector 25 and displaces the flow stop member 34 from the seat 21 of the distal check valve 31. Fluid flows upwardly into and through the annular passage 18 that surrounds the tubular flow divider 14, through the "S"-curve formed by the distal end 64 of the tubular extension 63 extending into the central passage 16 of the tubular flow divider 14, radially inwardly into the tubular extension 63 and then through the proximal connector 26 to the production tubing (not shown) connected thereto. As fluid flows through this tortuous pathway, the flowing fluid unsettles and disturbs settled sand 57 thereby causing settled sand 57 to become entrained within the fluid flow. As the amount of the accumulated settled sand 57 atop the flow stop member 54 of the proximal check valve 51 becomes more unsettled and disturbed, the fluid pressure on the flow stop member 54 causes it to become displaced from the seat 55 resulting in fluidization of the column 59 of settled sand 57, which results in further entrainment of the settled sand 57 in the flow of fluid through the sand fallback tool 10. The design of the sand fallback tool 10 enables the removal of the column 59 of settled sand 57 from the central passage 16 of the tubular flow divider 14 within a relatively short period after restoration of operation of the submersible pump.

Figure 7:
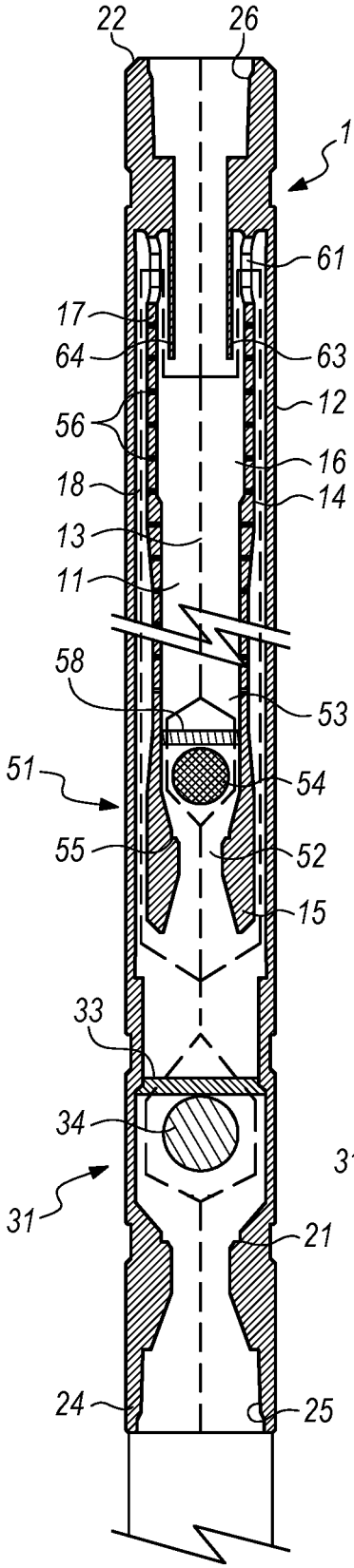
FIG. 7 is a cross-sectional elevation view of an alternate embodiment of the sand fallback tool of the present invention.

FIG. 7 is a cross-sectional elevation view of an alternate embodiment of the sand fallback tool 10 of the present invention. The sand fallback tool 10 of FIG. 7 comprises an elongate outer tubular body 12 having a proximal end 22 with a proximal connector 26 for coupling the sand fallback tool 10 to production tubing (not shown), a distal end 24 having a distal connector 25 for coupling to a submersible pump (not shown), and a chamber 11 within the outer tubular body 12 between the proximal connector 26 and the distal connector 25. The chamber 11 within the outer tubular body 12 is divided into passages by a tubular flow divider 14 having a distal end 15, a central passage 16 within the tubular flow divider 14, and a proximal end 17. The tubular flow divider 14 of the sand fallback tool 10 of FIG. 7 is supported within the chamber 11 of the outer tubular body 12 centrally about the axis 13 to divide the portion of the chamber 11 in which the tubular flow divider 14 is supported into two flow passages through which fluid entering the distal connector 25 may flow to the proximal connector 26. The two flow passages include a central passage 16 disposed within the flow divider 14 and surrounding the axis 13 and the annular passage 18 radially intermediate the tubular flow divider 14 and the outer tubular body 12.

The sand fallback tool 10 of FIG. 7 further includes a distal check valve 31 having a permeable divider 33 disposed within the chamber 11 of the outer tubular body 12 proximal to the distal connector 25 and a flow stop member 34 movably captured below the divider 33. The divider 33 of the distal check valve 31 may include a plurality of holes or slots through which fluid entering the chamber 11 through the distal connector 25 flows with the distal check valve 31 in the open position illustrated in FIG. 7. The distal check valve 31 of FIG. 7 further includes a seat 21 disposed within the chamber 11 of the outer tubular body 12, the seat 21 sized for sealed engagement with the flow stop member 34. FIG. 7 illustrates a flow stop member 34 that is spherical in shape, but in other embodiments of the sand fallback tool 10 of the present invention, the flow stop member 34 can be an elongate plug with a tapered nose, a conical shape, or any other shape that can maintain proper orientation within the cage 30 and sealably engage the seat 21 of the distal check valve 31 to prevent unwanted fluid flow or sand passage from the distal connector 25 into the submersible pump (not shown) connected thereto during interruptions of operation of the submersible pump. The flow stop member 34 may be of a material for providing to the flow stop member 34 a combination of size, weight and surface friction to fluid flow upwardly through the distal connector 25 and then around the flow stop member 34 when the flow stop member 34 is displaced from the seat 21 and so that the flow stop member 34 later drops to sealably engage the seat 21 upon termination of operation of the submersible pump (not shown), only to be again displaced from the seat 21 by fluid pressure and flow of fluid entering the chamber 11 through the distal connector 25 during resumed operation of the submersible pump.

The central passage 16 of the tubular flow divider 14 of the sand fallback tool 10 of FIG. 7 further includes a distal necked portion 52 that is smaller in size than an adjacent portion 53 of the central passage 16 that is distal to the distal end 15 of the tubular flow divider 14. The central passage 16 further includes a proximal check valve 51 that is proximal to the distal end 15 and a proximal flow stop member 54 within the central passage 16. The proximal check valve 51 further includes a seat 55 within the tubular flow divider 14 at the distal necked portion 52 that is shaped for sealed engagement with the proximal flow stop member 54. The proximal flow stop member 54 of the proximal check valve 51 engages the seat 55 to prevent fluid and settled sand from flowing from the distal end 15 of the central passage 16. The sand fallback tool 10 of FIG. 7 further includes a permeable divider 58 within the central passage 16 to limit the movement of the flow stop member 54 within the central passage 16. The sand fallback tool 10 of FIG. 7 further includes a tubular extension 63 coupled to the proximal connector 26 of the outer tubular body 12 and extending distally into the central passage 16. The distal end 64 of the tubular extension 63 is disposed within the central passage 16. The tubular extension 63 and the tubular flow divider 16 causes fluid flowing upwardly within the annular passage 18 to flow through an "S"-shaped pathway disposed at the proximal end 17 of the flow passage divider 14. The flow of fluid within the annular passage 18 flows upwardly to the proximal end 17 of the tubular flow divider 14, then passes radially inwardly through the holes 61 adjacent to the proximal end 17 of the tubular flow divider 14, then fluid flows downwardly between the tubular extension 63 and the tubular flow divider 14, then radially inwardly and into the distal end 64 of the tubular extension 63 to mix with fluid flowing from the central passage 16 (if any), and then upwardly from the sand fallback tool 10 through the proximal connector 26. The tubular extension 63 extends the bore of the proximal connector 26 downwardly into the central passage 16. This arrangement substantially prevents settling sand that may enter the sand fallback tool 10 through the proximal connector 26 to settle within the central passage 16 instead of settling within the annular passage 18, as will be discussed in more detail in connection with FIG. 8.

The tubular flow divider 14 of the sand fallback tool 10 of FIG. 7 further includes a plurality of apertures 56. The apertures 56 allow pressurized fluid to flow from the annular passage 18 through the apertures 56 in the tubular flow divider 14 into the central passage 16 upon restoration of operation of the submersible pump, as discussed in connection with FIG. 9 below. The apertures 56 in the tubular flow divider 14 thereby promote fluidization and unsettling of the column 59 of settled sand 57 accumulated within the central passage 16 as illustrated in FIG. 8, and may also provide for the relieving of pressurized pockets of gas that may remain within the column 59 of settled sand 57 after the sand fallback tool 10 is removed from a well.

Figure 8:
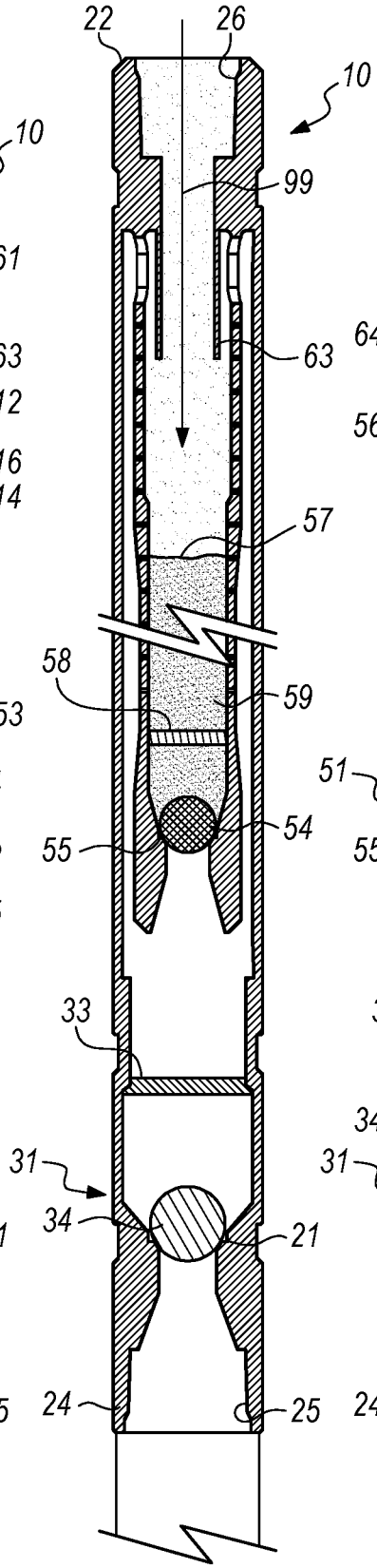
FIG. 8 is the cross-sectional elevation view of the embodiment of the sand fallback tool of FIG. 7 after interruption of the power supply to the submersible pump (not shown) and after settling sand has settled from the stagnant fluid in the production tubing (not shown) above the tool through the proximal connector and into the central passage of the tool to accumulate on the flow stop member of the check valve therewithin.

FIG. 8 is the cross-sectional elevation view of the embodiment of the sand fallback tool 10 of FIG. 7 after interruption of the power supply to the submersible pump (not shown) and after a column 59 of settled sand 57 has settled from the stagnant fluid in the production tubing (not shown) above the sand fallback tool 10 through the proximal connector 26, through the tubular extension 63 and into the central passage 16 of the sand fallback tool 10. The settled sand 57 is shown in FIG. 8 to have accumulated into a column 59 of settled sand 57 atop the seated flow stop member 54 of the proximal check valve 51, which is shown in FIG. 8 in the closed position. There is an unobstructed axial settling path 99 from the proximal connection 26 into the central passage 16 of tubular divider 14 that is supported within the chamber 11 of the outer tubular body 12. It can be seen in FIG. 8 how the column 59 of settled sand 57 has settled through the permeable divider 58 that limits movement of the flow stop member 54 and onto the flow stop member 54. The tubular extension 63 of the embodiment of the sand fallback tool 10 of FIGS. 7-9 does not contain holes as it does in the embodiment of the sand fallback tool 10 of FIG. 1-3 because the permeable divider 58 prevents the flow stop member 54 from engaging and obstructing fluid flow into the tubular extension 63.

Figure 9:
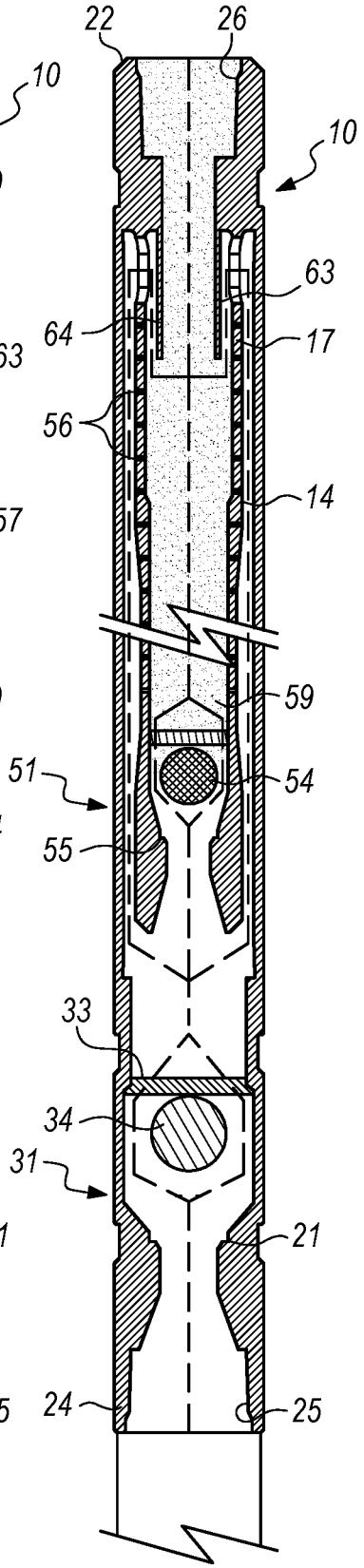
FIG. 9 is the cross-sectional elevation view of an embodiment of the sand fallback tool of FIGS. 7 and 8 after restoration of power to the submersible pump and resumption of fluid flow upwardly through the tool.

FIG. 9 is the cross-sectional elevation view of an embodiment of the sand fallback tool 10 of FIGS. 7 and 8 after restoration of power to the submersible pump (not shown) and resumption of fluid flow upwardly through the sand fallback tool 10. Pressurized fluid is pumped into the distal connector 25 and displaces the flow stop member 34 from the seat 21 of the distal check valve 31. Fluid flows upwardly into the annular passage 18, radially inwardly through the holes 61 in the tubular flow divider 14, downwardly between the tubular flow divider 14 and the tubular extension 63, radially inwardly and then into the distal end 64 of the tubular extension 63, and fluid exits the sand fallback tool 10 through the proximal connector 26 to the production tubing (not shown) connected thereto. As fluid flows through this pathway, the flowing fluid unsettles and disturbs settled sand 57 thereby causing settled sand 57 to become entrained within the fluid flow. As the amount of the accumulated column 59 of settled sand 57 atop the flow stop member 54 of the proximal check valve 51 becomes more unsettled, the fluid pressure bearing on the flow stop member 54 causes it to become displaced from the seat 55 and fluid begins to channel and flow through the column 59 of the settled sand 57, which results in further entrainment of the settled sand 57 in the flow of fluid through the sand fallback tool 10. In addition, pressurized fluid within the annular passage 18 flows through apertures 56 in the tubular flow divider 14 into the central passage 16 to further fluidize and unsettle the column 59 of settled sand 57 accumulated within the central passage 16 of the tubular flow divider 14. The apertures 56 in the tubular flow divider 14 are large enough to allow fluid flow from the annular passage 18 into the central passage 16, but small enough for the tubular flow divider 14 to provide support for accumulation of a column 59 of settled sand 57 therewithin. It will be understood that sand, like many other materials, can accumulate within a fluid with sufficient cohesion to create a column 59 of settled sand 57 within the central passage 16 of the tubular flow divider 14 without sand escaping the central passage 16 through the apertures 56 to enter the annular passage 18.

Figure 10:
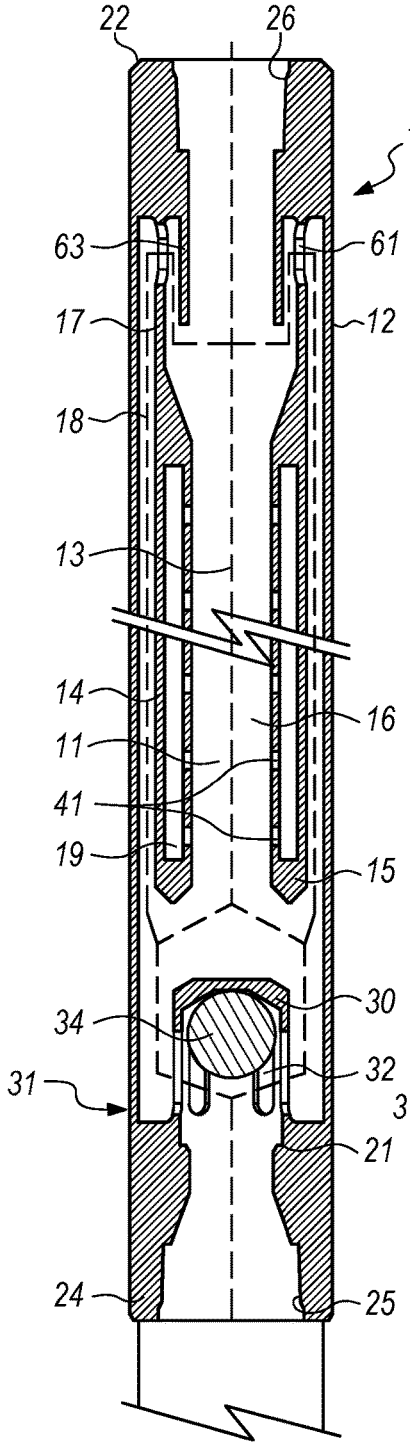
FIG. 10 is a cross-sectional elevation view of an alternate embodiment of the sand fallback tool of the present invention.

FIG. 10 is a cross-sectional elevation view of an alternate embodiment of the sand fallback tool 10 of the present invention. The sand fallback tool 10 of FIG. 10 comprises an elongate outer tubular body 12 having a proximal end 22 with a proximal connector 26 for coupling the sand fallback tool 10 to production tubing (not shown), a distal end 24 with a distal connector 25 for coupling to a submersible pump (not shown), and a chamber 11 within the outer tubular body 12 therebetween. The chamber 11 within the outer tubular body 12 is divided into flow passages by a tubular flow divider 14 having a distal end 15, a central passage 16 within the tubular flow divider 14, and a proximal end 17. The tubular flow divider 14 divides the chamber 11 into a central passage 16 within the tubular flow divider 14 and an annular passage 18 radially intermediate the tubular flow divider 14 and the outer tubular body 12. Holes 61 in the tubular flow divider 14 adjacent to the proximal end 17 allow fluid flow from the annular passage 18 to flow radially inwardly towards the tubular extension 63, then downwardly between the tubular extension 63 and the proximal end 17 of the tubular flow divider 14, then radially inwardly to mix with fluid flowing upwardly from the central passage 16, if any, then to exit the chamber 11 and the apparatus 10 through the tubular extension 63 and the proximal connector 26. The tubular flow divider 14 of the sand fallback tool 10 of FIG. 10 is supported within the chamber 11 of the outer tubular body 12 centrally about the axis 13 to divide the portion of the chamber 11 in which the tubular flow divider 14 is supported into two fluid flow passages through which fluid entering the sand fallback tool 10 through the distal connector 25 may flow to the proximal connector 26. The tubular flow divider 14 of the sand fallback tool 10 of FIG. 10 further includes a bypass annulus 19 within the tubular flow divider 14 and in fluid communication through a plurality of bypass apertures 41 with the central passage 16 of the tubular flow divider 14. The bypass apertures 41 allow fluid to flow into the distal end 15 of the tubular flow divider 14 and to thereby enter the central passage 16, then to flow through the bypass apertures 41 into the bypass annulus 19, upwardly within the bypass annulus 19 and then from the bypass annulus 19 through the bypass apertures 41 back into the central passage 16. The bypass apertures 41 and the bypass annulus 19 thereby provide additional agitation, fluidization, entrainment and removal of a column 59 of settled sand 57 (not shown in FIG. 10—see FIG. 11) from the central passage 16 upon resumption of operation of the submersible pump, as illustrated in FIG. 12. The embodiment of the sand fallback tool 10 of FIGS. 10-12 does not include a proximal check valve as does the embodiments of FIGS. 1-9.

Figure 11:
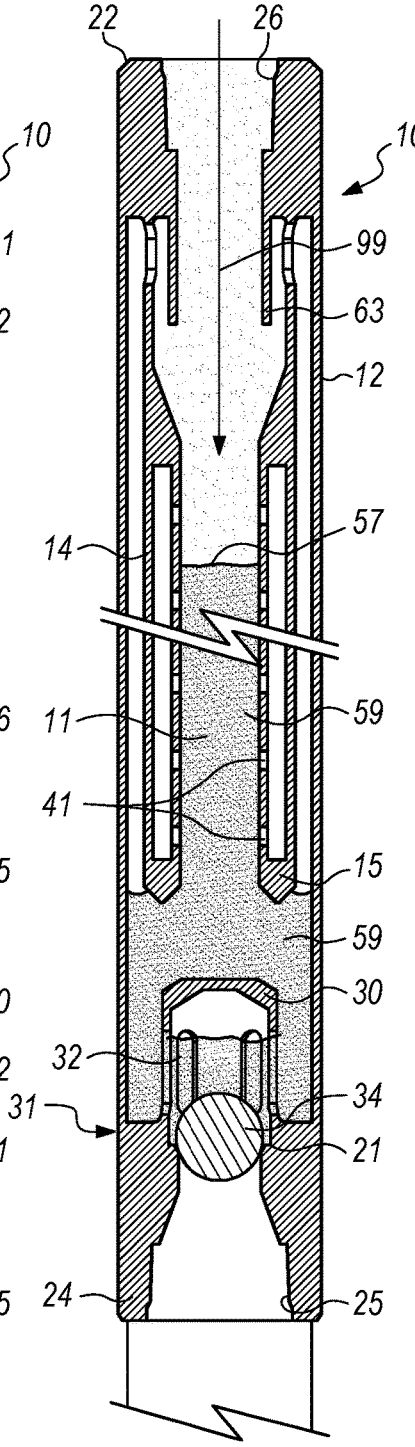
FIG. 11 is the cross-sectional elevation view of the embodiment of the sand fallback tool of FIG. 10 after interruption of the power supply to the submersible pump (not shown) and after settling sand has settled from the stagnant fluid in the production tubing (not shown) above the tool through the proximal connector and into the central passage of the tool to accumulate on the cage below the central passage and proximal to the distal end of the tool that houses the flow stop member of the check valve therewithin.
Figure 12:
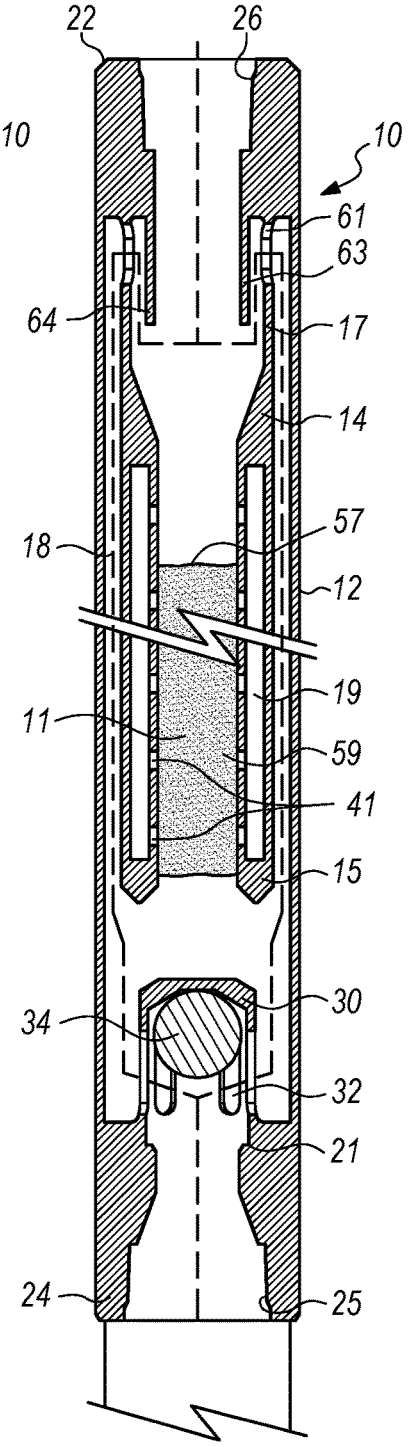
FIG. 12 is the cross-sectional elevation view of an embodiment of the sand fallback tool of FIGS. 10 and 11 after restoration of power to the submersible pump and resumption of fluid flow upwardly through the tool.

FIG. 11 is the cross-sectional elevation view of the embodiment of the sand fallback tool 10 of FIG. 10 after interruption of the power supply to the submersible pump (not shown) and after a column 59 of settled sand 57 has settled from the stagnant fluid in the production tubing (not shown) above the sand fallback tool 10 through the proximal connector 26 and into the central passage 16 of the sand fallback tool 10, then through the central passage 16 to accumulate atop the cage 30 of the distal check valve 31 below the tubular flow divider 14 and below the central passage 16. There is an unobstructed axial settling path 99 from the proximal connection 26 into the central passage 16 of tubular divider 14 that is supported within the chamber 11 of the outer tubular body 12. The distal check valve 31 is proximal to the distal end 24 of the sand fallback tool 10 and includes a cage 30 that limits the range of movement of the flow stop member 34 of the distal check valve 31. The column 59 of settled sand 57 is shown as filling portions of the chamber 11 of the outer tubular body 12 of the sand fallback tool 10 below the distal end 15 of the tubular flow divider 14 because there is no proximal check valve within the central passage 16 of the tubular flow divider 14 to prevent settled sand 57 from passing through the central passage 16. Once the level of the settled sand 57 rises to the distal end 15 of the tubular flow divider 14, the column 59 of settled sand 57 then begins accumulating within the central passage 16 as illustrated in FIG. 11.

FIG. 12 is the cross-sectional elevation view of an embodiment of the sand fallback tool 10 of FIGS. 10 and 11 after restoration of power to the submersible pump and resumption of fluid flow upwardly through the sand fallback tool 10. Pressurized fluid enters the sand fallback tool 10 through the distal connector 25 and, due to fluid pressure and rapid flow, immediately clears the settled sand 57 from the area of the chamber 11 adjacent to the holes 32 of the cage 30 of the distal check valve 31, and from around and atop the cage 30 of the distal check valve 31 that limits the movement of the flow stop member 34 of the distal check valve 31. The removed portion of the settled sand 57 is entrained in and removed by fluid flow moving up the annular passage 18, then radially inwardly through the holes 61 in the tubular flow divider 14, downwardly between the tubular extension 63 and the tubular flow divider 14, through the "S"-curve formed by the tubular extension 63 extending into the proximal end 17 of the tubular flow divider 14, and from the sand fallback tool 10 through the proximal connector 26. The remaining portion of the settled sand 57 in the central passage 16 will then be removed by pressurized fluid entering the distal end 15 of the tubular flow divider 14 and then flowing through the bypass apertures 41 into the bypass annulus 19. Fluid within the bypass annulus 19 will re-enter the central passage 16 through the bypass apertures 41 at or near the top of the settled sand 57 to entrain and remove the settled sand 57 from the central passage 16 until the central passage 16 has been cleared, and then simultaneous fluid flow through both the central passage 16 and the annular passage 18 resumes.

Figure 13:
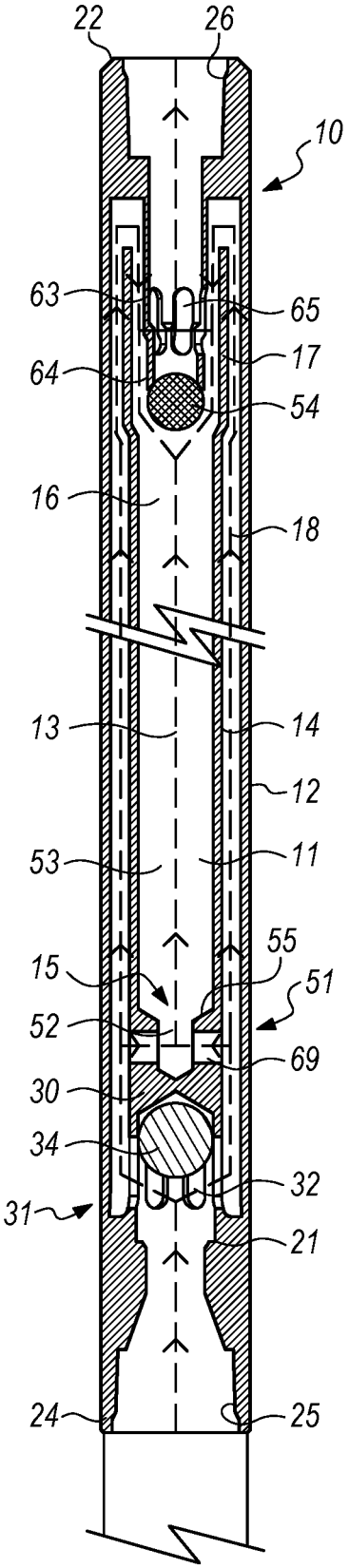
FIG. 13 is a cross-sectional elevation view of an alternate embodiment of the sand fallback tool of the present invention.

FIG. 13 is a cross-sectional elevation view of an alternate embodiment of the sand fallback tool 10 of the present invention. The embodiment of the sand fallback tool 10 of FIG. 13 comprises an elongate outer tubular body 12 having a proximal end 22 with a proximal connector 26 for coupling the sand fallback tool 10 to a string of production tubing (not shown), a distal end 24 with a distal connector 25 for coupling to a submersible pump (not shown), and a chamber 11 within the outer tubular body 12 axially between the proximal connector 26 and the distal connector 25. The chamber 11 within the outer tubular body 12 is divided into passages by a tubular flow divider 14 having a distal end 15, a central passage 16 within the tubular flow divider 14, and a proximal end 17. The tubular flow divider 14 of the sand fallback tool 10 of FIG. 13 is supported within the chamber 11 of the outer tubular body 12 centrally about the axis 13 to divide a portion of the chamber 11 in which the tubular flow divider 14 is supported into two flow passages through which fluid entering the distal connector 25 may flow to the proximal connector 26. The two flow passages include a central passage 16 disposed within the tubular flow divider 14 and surrounding the axis 13 and the annular passage 18 radially intermediate the tubular flow divider 14 and the outer tubular body 12.

The sand fallback tool 10 of FIG. 13 further includes a distal check valve 31 having a cage 30 disposed within the chamber 11 of the outer tubular body 12 proximal to the distal connector 25 and a flow stop member 34 movably captured within the cage 30. The cage 30 of the distal check valve 31 includes a plurality of holes 32 through which fluid entering the chamber 11 through the distal connector 25 flows with the distal check valve 31 in the open position illustrated in FIG. 13. The distal check valve 31 of FIG. 13 further includes a seat 21 disposed within the chamber 11 of the outer tubular body 12, the seat 21 sized for sealed engagement with the flow stop member 34. FIG. 13 illustrates a flow stop member 34 that is spherical in shape, but in other embodiments of the sand fallback tool 10 of the present invention, the flow stop member 34 can be an elongate plug with a tapered nose, a conical shape, or any other shape that can maintain proper orientation and sealably engage the seat 21 of the distal check valve 31 to prevent unwanted fluid flow or sand passage into the submersible pump during interruptions of operation of the submersible pump. The flow stop member 34 may be of a material for providing to the flow stop member 34 a combination of weight and friction to fluid flow there around so that the flow stop member 34 drops within the cage 34 to sealably engage the seat 21 upon termination of operation of the submersible pump (not shown) and is displaced from the seat 21 by fluid pressure and flow of fluid entering the chamber 11 through the distal connector 25 during operation of the submersible pump.

The central passage 16 of the tubular flow divider 14 of the sand fallback tool 10 of FIG. 13 further includes a distal necked portion 52 that is smaller in size than an adjacent portion 53 of the central passage 16 proximal to the distal end 15 of the tubular flow divider 14. The central passage 16 proximal to the distal end 15 further includes a proximal check valve 51 including the distal necked portion 52 and a proximal flow stop member 54 within the central passage 16. The proximal check valve 51 further includes a seat 55 within the tubular flow divider 14 adjacent to the distal necked portion 52 that is shaped for sealed engagement with the proximal flow stop member 54. As with the distal check valve 31, the proximal flow stop member 54 engages the seat 55 to prevent fluid and settled sand from flowing from the distal end 15 of the central passage 16 during interruptions of operation of the submersible pump (not shown). The sand fallback tool 10 of FIG. 13 further includes a tubular extension 63 coupled to the proximal connector 26 of the outer tubular body 12 and extending distally into the proximal end 17 of the tubular flow divider 14. The distal end 64 of the tubular extension 63 is disposed within the central passage 16. As with the embodiment of the apparatus 10 illustrated in FIGS. 1-3, the distal end 64 of the tubular extension 63 serves to limit the range of upwardly movement of the proximal flow stop member 54 when the proximal flow stop member 54 is displaced from the seat 55 by fluid pressure and fluid flow is applied to the proximal flow stop member 54 by operation of the submersible pump (not shown) coupled to the distal connector 25 of the sand fallback tool 10. As with the embodiment of the apparatus 10 illustrated in FIGS. 1-3, the tubular extension 63 includes holes 65 that continue to allow fluid to flow into the tubular extension 63 when the flow stop member 54 engages the distal end 64 of the tubular extension 63. The tubular extension 63 and the tubular flow divider 16 cause fluid flowing upwardly within the annular passage 18 to flow through an "S"-shaped pathway disposed at the proximal end 17 of the flow passage divider 14. The flow of fluid within the annular passage 18 flows upwardly to the proximal end 17 of the tubular flow divider 14, then flows radially inwardly towards the tubular extension 63, then downwardly to the holes 65 within the tubular extension 63 and then radially inwardly through the holes 65 into the tubular extension 63 to mix with fluid flowing from the central passage 16 (if any) and then from the sand fallback tool 10 through the proximal connector 26. The tubular extension 63 extends the bore of the proximal connector 26 downwardly into the central passage 16. This arrangement provides an unobstructed axial settling path 99 (see FIG. 14) through which settling sand may settle from the production tubing (not shown) coupled to the proximal connector 26 during periods of interruption of the power supply to a submersible pump (now shown) coupled to the distal connector 25, and this arrangement causes settling sand that may enter the sand fallback tool 10 through the proximal connector 26 to settle within the central passage 16 instead of settling within the annular passage 18, as will be discussed in more detail in connection with FIG. 14. Fluid that does not flow through the full length of the annular passage 18 passes radially inwardly through channels 69 to enter the central passage 16, then flows upwardly through the central passage 16 to the holes 65 of the tubular extension 63 and there mixes with the fluid flow emerging from the annular passage 18, then flowing radially inwardly towards the tubular extension 63, then downwardly between the tubular extension 63 and the proximal end 17 of the tubular flow divider 14 to the holes 65 (i.e., through the "S"-shaped flow path) to mix with the fluid flowing through the central passage 16 and exiting the sand fallback tool 10 through the tubular extension 63 and the proximal connector 26.

Figure 14:
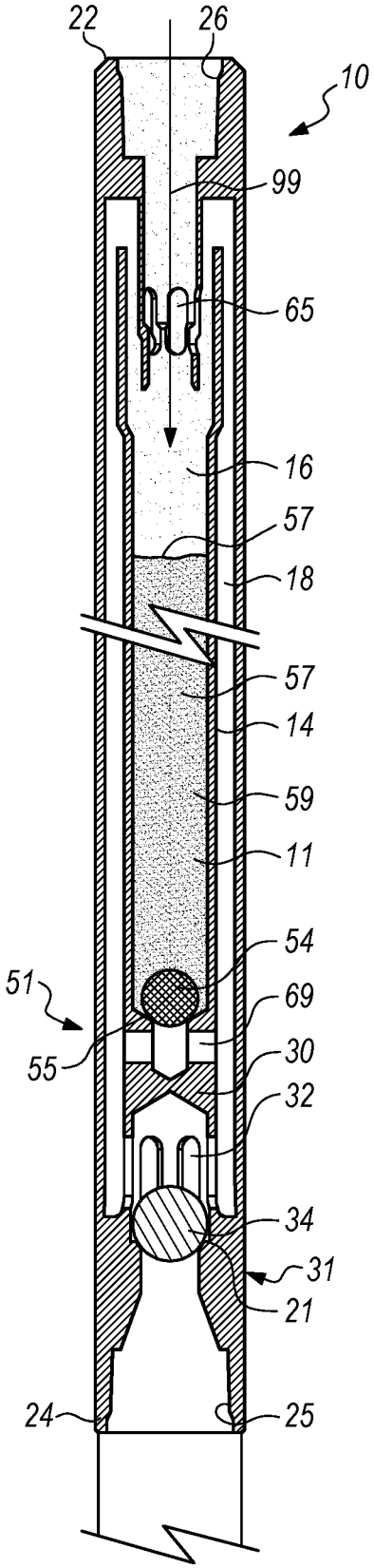
FIG. 14 is the cross-sectional elevation view of the embodiment of the sand fallback tool of FIG. 13 after interruption of the power supply to the submersible pump (not shown) and after settling sand has settled from the stagnant fluid in the production tubing (not shown) above the tool through the proximal connector and into the central passage of the tool to accumulate on the flow stop member of the check valve therewithin.

FIG. 14 is the cross-sectional elevation view of the embodiment of the sand fallback tool 10 of FIG. 13 after interruption of the power supply to the submersible pump (not shown) and after a column 59 of settled sand 57 has settled from the stagnant column of produced fluid residing in the production tubing (not shown) above the sand fallback tool 10. As described above in connection with other embodiments, upon interruption of the power supply to the submersible pump, the proximal flow stop member 54 sealably engages the seat 55 of the proximal check valve 51 and the distal flow stop member 34 sealably engages the seat 21 of the distal check valve 31 due to the density of the proximal flow stop member 54 and the distal flow stop member 34 being greater than the density of the fluid produced through the sand fallback tool 10. FIG. 14 shows the settled sand 57 that settles downwardly through the unobstructed axial settling path 99 from the production tubing and entering the sand fallback tool 10 through the proximal connector 26, then through the tubular extension 63 extending downwardly therefrom, and into the central passage 16 to accumulate atop the proximal flow stop member 54 engaged with the seat 55 of the proximal check valve 51. FIG. 14 shows that the annular passage 18 remains open and unobstructed by settled sand due to the alignment of the central passage 16 with the tubular extension 63. The holes 65 in the tubular extension 63 are below the proximal end 17 of the tubular extension 63 to prevent or minimize unwanted settling sand entry into the annular passage 18. The sizes of the tubular extension 63 and the central passage 16 into which the tubular extension 63 extends can be selected to provide a desired pressure drop in the fluid produced up the annular passage 18 so that there is a pressure differential from the annular passage 18 into the central passage 16.

Figure 15:
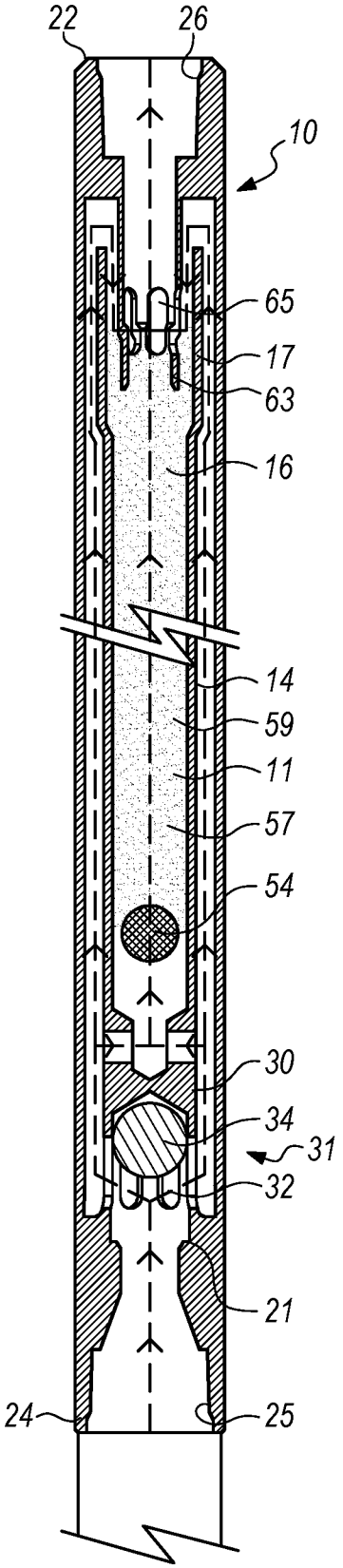
FIG. 15 is the cross-sectional elevation view of an embodiment of the sand fallback tool of FIGS. 13 and 14 after restoration of power to the submersible pump and resumption of fluid flow upwardly through the tool.

FIG. 15 is the cross-sectional elevation view of an embodiment of the sand fallback tool 10 of FIGS. 13 and 14 after restoration of power to the submersible pump (not shown) coupled to the distal connector 25 of the sand fallback tool 10 and resumption of fluid flow upwardly through the sand fallback tool 10. Upon restoration of the operation of the submersible pump, fluid pressure initially bears against and displaces the flow stop member 34 of the distal check valve 31 from the seat 21 to provide fluid flow from the submersible pump, through the distal connector 25, through the holes 32 of the cage 30 of the distal check valve 31, through the full length of the annular passage 18, then radially inwardly towards the tubular extension 63, then downwardly between the tubular extension 63 and the proximal end 17 of the tubular flow divider 14 to the holes 65 (i.e., through the "S"-curve at the proximal end 17 of the tubular flow divider 14 to exit from the sand fallback tool 10 through the proximal connector 26. As flow through these structures occurs, the turbulence of the flow causes unsettling and fluidization of at least a top portion of the column 59 of settled sand 57 within the central passage 16. At first, small amounts of the settled sand begin to leave the column 59 of settled sand 57 in the central passage 16 and become entrained in the fluid flow emerging from the annular passage 18 and leaving the sand fallback tool 10 through the proximal connector 26. As the column 59 lightens, fluid pressure against the flow stop member 54 of the proximal check valve 51 eventually displaces the flow stop body 54 from the seat 55 and fluid begins to flow radially inwardly through the channels 69, into the central passage 16, around the flow stop member 54 and channeling through the column 59 of settled sand 57, thereby further fluidizing and entraining sand in the fluid flow exiting the sand fallback tool 10 at the proximal connector 26.

Figure 16:
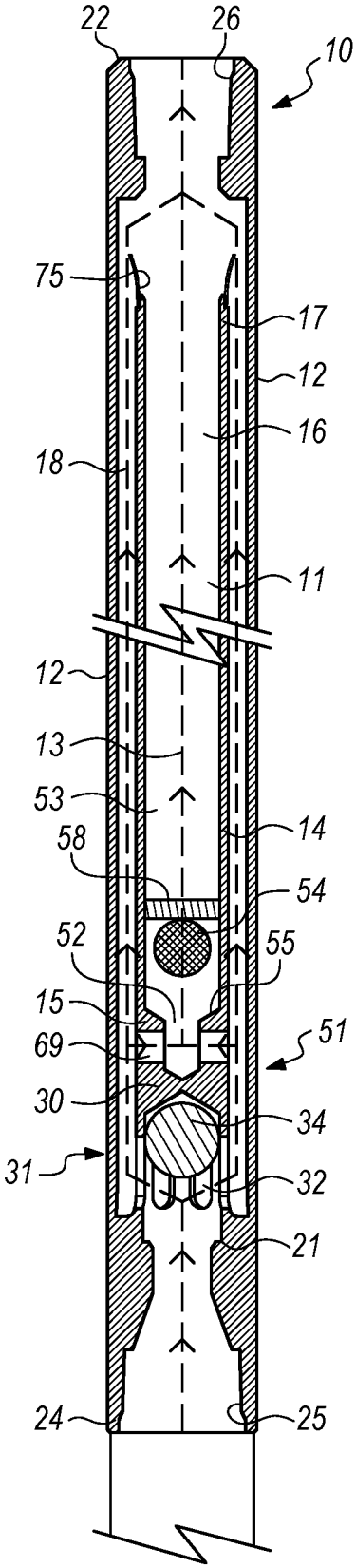
FIG. 16 is a cross-sectional elevation view of an alternate embodiment of the sand fallback tool of the present invention.

FIG. 16 is a cross-sectional elevation view of an alternate embodiment of the sand fallback tool 10 of the present invention. The embodiment of the sand fallback tool 10 of FIG. 16 comprises an elongate outer tubular body 12 having a proximal end 22 with a proximal connector 26 for coupling the sand fallback tool 10 to a string of production tubing (not shown), a distal end 24 with a distal connector 25 for coupling to a submersible pump (not shown), and a chamber 11 within the outer tubular body 12 axially between the proximal connector 26 and the distal connector 25. The chamber 11 within the outer tubular body 12 is divided into passages by a tubular flow divider 14 having a distal end 15, a central passage 16 within the tubular flow divider 14, and a proximal end 17. The tubular flow divider 14 of the sand fallback tool 10 of FIG. 16 is supported from the distal end 15 within the chamber 11 of the outer tubular body 12 centrally about the axis 13 to divide the portion of the chamber 11 in which the tubular flow divider 14 is supported into two flow passages through which fluid entering the distal connector 25 may flow to the proximal connector 26. The two flow passages include a central passage 16 disposed within the flow divider 14 and surrounding the axis 13 and the annular passage 18 radially intermediate the tubular flow divider 14 and the outer tubular body 12.

The sand fallback tool 10 of FIG. 16 further includes a distal check valve 31 having a cage 30 disposed within the chamber 11 of the outer tubular body 12 proximal to the distal connector 25 and a flow stop member 34 movably captured within the cage 30. The cage 30 of the distal check valve 31 includes a plurality of holes 32 through which fluid entering the chamber 11 through the distal connector 25 flows with the distal check valve 31 in the open position illustrated in FIG. 16. The distal check valve 31 of FIG. 16 further includes a seat 21 disposed within the chamber 11 of the outer tubular body 12, the seat 21 sized for sealed engagement with the flow stop member 34. FIG. 16 illustrates a flow stop member 34 that is spherical in shape, but in other embodiments of the sand fallback tool 10 of the present invention, the flow stop member 34 can be an elongate plug with a tapered nose, a conical shape, or any other shape that can maintain proper orientation and sealably engage the seat 21 of the distal check valve 31 to prevent unwanted fluid flow or sand passage into the submersible pump during interruptions of operation of the submersible pump. The flow stop member 34 may be of a material for providing to the flow stop member 34 a combination of weight and friction to fluid flow there around so that the flow stop member 34 drops within the cage 30 to sealably engage the seat 21 upon termination of operation of the submersible pump (not shown) and is displaced from the seat 21 by fluid pressure and flow of fluid entering the chamber 11 through the distal connector 25 during operation of the submersible pump.

The central passage 16 of the tubular flow divider 14 of the sand fallback tool 10 of FIG. 16 further includes a distal necked portion 52 that is smaller in size than an adjacent portion 53 of the central passage 16 that is proximal to the distal end 15 of the tubular flow divider 14. The central passage 16 proximal to the distal end 15 further includes a proximal check valve 51 including the distal necked portion 52 and a proximal flow stop member 54 within the central passage 16. The proximal check valve 51 further includes a seat 55 within the tubular flow divider 14 adjacent to the distal necked portion 52 that is shaped for sealed engagement with the proximal flow stop member 54. As with the distal check valve 31, the proximal flow stop member 54 engages the seat 55 to prevent fluid and settling sand from flowing from the distal end 15 of the central passage 16 during interruptions of power supply to the submersible pump coupled to the distal connector 25 of the apparatus 10. The sand fallback tool 10 of FIG. 16 further includes a resilient funnel member 75 coupled to the proximal end 17 of the tubular flow divider 14, the funnel member 75 being shaped as an upwardly expanding section of a cone to cause fluid and settling sand entering the outer tubular body 12 through the proximal connector 26 during periods in which the submersible pump (not shown) coupled to the distal connector 25 is not in operation to be guided to and to enter the proximal end 17 of the tubular flow divider 14 and to thereafter move down the central passage 16 towards the distal end 15. The funnel member 75 is resiliently deformable and may be made of rubber or some other material that can be deformed by application of force and then resiliently restored to its original shape after the forces causing deformation are removed. The permeable divider 58 within the central passage 16 serves to limit the range of upwardly movement of the proximal flow stop member 54 when the proximal flow stop member 54 is displaced from the seat 55 by fluid pressure applied to the proximal flow stop member 54 by operation of the submersible pump (not shown) coupled to the distal connector 25 of the sand fallback tool 10. The flow of fluid entering the sand fallback tool 10 through the distal connector 25 may flow through both the central passage 16 and the annular passage 18. The flow of fluid within the annular passage 18 flows upwardly to the proximal end 17 of the tubular flow divider 14, the fluid pressure collapses and displaces the funnel member 75 a sufficient amount to allow the fluid flow within the annular passage 18 to move upwardly beyond the funnel member 75 and to flow radially inwardly to mix with fluid flowing upwardly from the central passage 16 (if any) before exiting the sand fallback tool 10 through the proximal connector 26. Fluid not flowing the full length of the annular passage 18 will flow upwardly through the central passage 16 within the tubular flow divider 14. The flow of fluid within the central passage 16 first flows radially inwardly through channels 69 to enter the central passage 16 and then upwardly through the central passage 16 to the proximal connector 26. This arrangement substantially causes settling sand that may enter the sand fallback tool 10 through the proximal connector 26 during interruption of the power supply to the submersible pump (not shown) to settle within the central passage 16 (instead of settling within the annular passage 18), as will be discussed in more detail in connection with FIG. 17.

Figure 17:
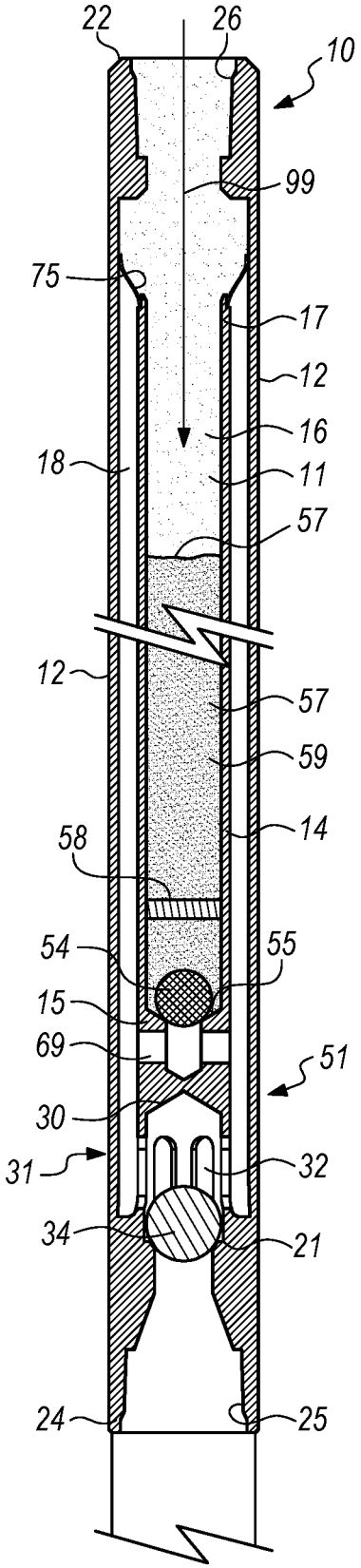
FIG. 17 is the cross-sectional elevation view of the embodiment of the sand fallback tool of FIG. 16 after interruption of the power supply to the submersible pump (not shown) and after settling sand has settled from the stagnant fluid in the production tubing (not shown) above the tool through the proximal connector and into the central passage of the tool to accumulate on the flow stop member of the check valve therewithin.

FIG. 17 is the cross-sectional elevation view of the embodiment of the sand fallback tool 10 of FIG. 16 after interruption of the power supply to the submersible pump (not shown) and after settling sand 57 has settled from the stagnant column of produced fluid residing in the production tubing (not shown) above the sand fallback tool 10. As described above, the proximal flow stop member 54 engages the seat 55 of the proximal check valve 31 after interruption of the power supply and the distal flow stop member 34 engages the seat 21 of the distal check valve 31 due to the density of the proximal flow stop member 54 and the distal flow stop member 34 being greater than the density of the fluid produced through the sand fallback tool 10. FIG. 17 shows the settled sand 57 that settles downwardly from the production tubing and that enters the sand fallback tool 10 through the proximal connector 26, then is guided by the funnel member 75 extending upwardly from the proximal end 17 of the tubular flow divider 14 into the central passage 16 of the tubular flow divider 14 to accumulate atop the proximal flow stop member 54 engaged with the seat 55 of the proximal check valve 51. The settling sand 57 settles downwardly through the unobstructed axial settling path 99 into the central passage 16 to accumulate as a column 59 of settled sand 57 atop the seated proximal flow stop member 54. FIG. 17 shows that the annular passage 18 remains open and unobstructed by settled sand due to the alignment of the central passage 16 with the unobstructed axial settling path 99 and with the proximal connector 26, and due to the funnel member 75 being at its widest span due to the absence of fluid flow and fluid pressure in the annular passage 18 that can, when present, deflect the funnel member 75 radially inwardly as illustrated in FIG. 16.

Figure 18:
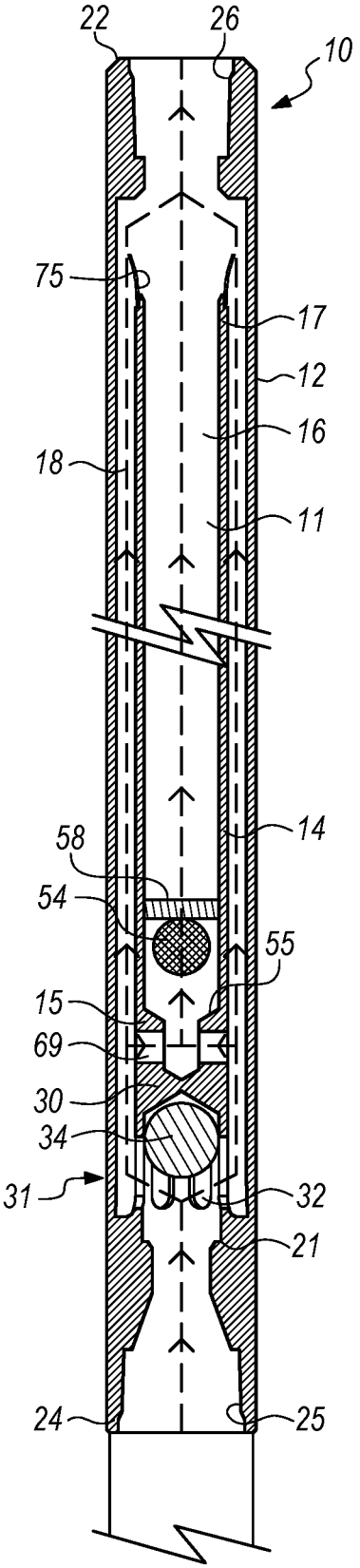
FIG. 18 is the cross-sectional elevation view of an embodiment of the sand fallback tool of FIGS. 16 and 17 after restoration of power to the submersible pump and resumption of fluid flow upwardly through the tool.

FIG. 18 is the cross-sectional elevation view of an embodiment of the sand fallback tool 10 of FIGS. 16 and 17 after restoration of power to the submersible pump (not shown) coupled to the distal connector 25 of the sand fallback tool 10 and resumption of fluid flow upwardly through the sand fallback tool 10. Upon restoration of the operation of the submersible pump, fluid pressure initially bears against and displaces the flow stop member 34 of the distal check valve 31 from the seat 21 to provide fluid flow from the submersible pump, through the distal connector 25, through the holes 32 of the cage 30 of the distal check valve 31, through the full length of the annular passage 18, past the funnel member 75 (now again collapsed in a deformed state by application of fluid pressure) to exit from the sand fallback tool 10 through the proximal connector 26. As flow through these structures occurs, the turbulence of the flow causes unsettling and fluidization of the column of settled sand 57 (see FIG. 17) within the central passage 16. At first, small amounts of the settled sand begin to leave the settled sand column in the central passage 16 and become entrained in the fluid flow emerging from the annular passage 18 and leaving the sand fallback tool 10 through the proximal connector 26. As the column 59 of settled sand 57 lightens, fluid pressure against the flow stop member 54 of the proximal check valve 51 displaces the flow stop body 54 from the seat 55 of the proximal check valve 51 and fluid begins to flow radially inwardly through the channels 69, into the central passage 16, around the flow stop member 54 and channels through the column 59 of settled sand 57, thereby further fluidizing and entraining sand in the fluid flow exiting the sand fallback tool 10 at the proximal connector 26.

Figure 19:
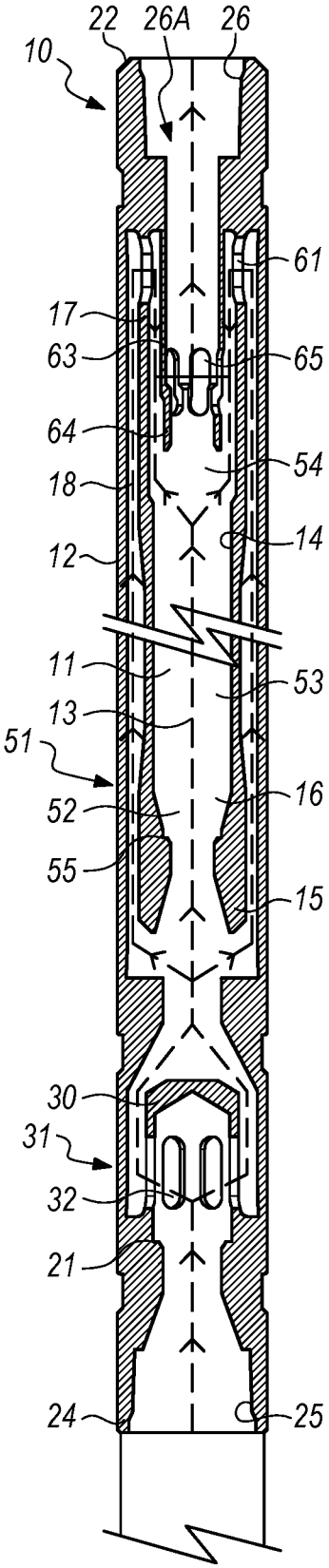
FIG. 19 is a cross-sectional elevation view of an embodiment of the sand fallback tool of the present invention.

FIG. 19 is a cross-sectional elevation view of an alternate embodiment of the sand fallback tool 10 of the present invention. The embodiment of the sand fallback tool 10 of FIG. 19 comprises an elongate outer tubular body 12 having a proximal end 22 with a proximal connector 26 for coupling the sand fallback tool 10 to a string of production tubing (not shown), a distal end 24 with a distal connector 25 for coupling to a submersible pump (not shown), and a chamber 11 within the outer tubular body 12 axially between the proximal connector 26 and the distal connector 25. The chamber 11 within the outer tubular body 12 is divided into passages by a tubular flow divider 14 having a distal end 15, a central passage 16 within the tubular flow divider 14, and a proximal end 17. The tubular flow divider 14 of the sand fallback tool 10 of FIG. 19 is supported from the proximal end 17 within the chamber 11 of the outer tubular body 12 centrally about the axis 13 to divide the portion of the chamber 11 in which the tubular flow divider 14 is supported into two flow passages through which fluid entering the distal connector 25 may flow to the proximal connector 26. The two flow passages include a central passage 16 disposed within the flow divider 14 and surrounding the axis 13 and the annular passage 18 radially intermediate the tubular flow divider 14 and the outer tubular body 12.

Figure 20:
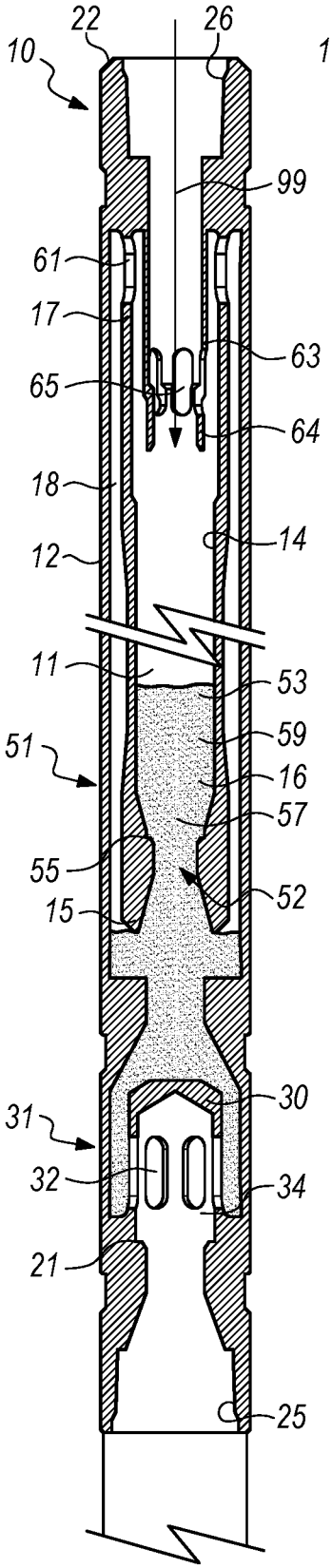
FIG. 20 is the cross-sectional elevation view of the embodiment of the sand fallback tool of FIG. 19 after interruption of the power supply to the submersible pump (not shown) and after settling sand has bridged and then settled from the stagnant fluid in the production tubing (not shown) above the tool through the proximal connector and into the central passage of the tool to accumulate therewithin.

The sand fallback tool 10 of FIG. 19 does not include a distal check valve. Instead, the embodiment of the sand fallback tool 10 of FIG. 19 comprises a cage 30 disposed within the chamber 11 of the outer tubular body 12 proximal to the distal connector 25, the cage 30 being designed to promote bridging of sand settling atop the cage 30, to obstruct the pathway of settling sand to prevent it from settling through the distal connector 25 and into the submersible pump (not shown). The cage 30 includes a plurality of holes 32 through which fluid entering or exiting the chamber 11 through the distal connector 25 flows. While the lack of a distal check valve (due to the lack of a flow stop member) at the distal connector 25 allows fluid and sand to flow into the sand fallback tool 10 through the unobstructed axial settling path 99 that includes the proximal connector 26, then into and through the chamber 11 and to exit the sand fallback tool 10 through the distal connector 25. The settling sand 57 passing through the restriction to flow caused by the distal necked portion 52 of the central passage 16 is subject to bridging, as shown in FIG. 20, at the distal necked portion 52 within the central passage 16 of the tubular flow divider 14 and also atop the cage 30. While the tendency of the sand entrained within the fluid to bridge is influenced by many factors such as, but not limited to, the velocity of the fluid flow, the amount of sand entrained in the fluid flow, the grain size of the sand, and the dimensions of the distal necked portion 52 relative to the diameter of the central passage 16 thereabove, the bridging of the sand promotes sand settling and accumulation within the central passage 16 and, after a column 59 of settled sand 57 accumulates within the central passage 16, it forces fluid that flows into the sand fallback tool 10 through the proximal connector 26 during interruptions in power supply to the submersible pump to flow through the "S"-curved flow pathway formed by the distal end 64 of the tubular extension 63 extending downwardly into the central passage 16 in order to get through the annular passage 18 to the distal connector 25. This tortuous pathway causes sand entrained in the fluid that enters the sand fallback tool 10 through the proximal connector 26 to settle within the central passage 16 and accumulate in a column 59 of settled sand 57, as shown in FIG. 20 and discussed below, rather than to follow the tortuous flow path of the "S"-curve, thereby leaving the annular passage 18 clear and unobstructed.

FIG. 20 is the cross-sectional elevation view of the embodiment of the sand fallback tool 10 of FIG. 19 after interruption of the power supply to the submersible pump (not shown) and after settling sand 57 has bridged and then settled from the stagnant fluid in the production tubing (not shown) above the sand fallback tool 10 through the proximal connector 26 and into the central passage 16 of the sand fallback tool 10 to accumulate in a column 59 therewithin. FIG. 20 shows the settled sand 57 that first bridges across the distal necked portion 52 and then continues to settle downwardly from the production tubing (not shown) and entering the sand fallback tool 10 through the proximal connector 26, then through the tubular extension 63 extending downwardly therefrom, and into the central passage 16 to accumulate therewithin. FIG. 20 shows that the annular passage 18 remains open and unobstructed by settled sand due to the alignment of the central passage 16 with the tubular extension 63 and the holes 65 in the tubular extension 63 being below the proximal end 17 of the tubular extension 63. The sizes of the tubular extension 63 and the central passage 16 into which the tubular extension 63 extends can be selected to provide a desired pressure drop in the fluid produced up the annular passage 18 so that there is a pressure differential from the annular passage 18 into the central passage 16.

Figure 21:
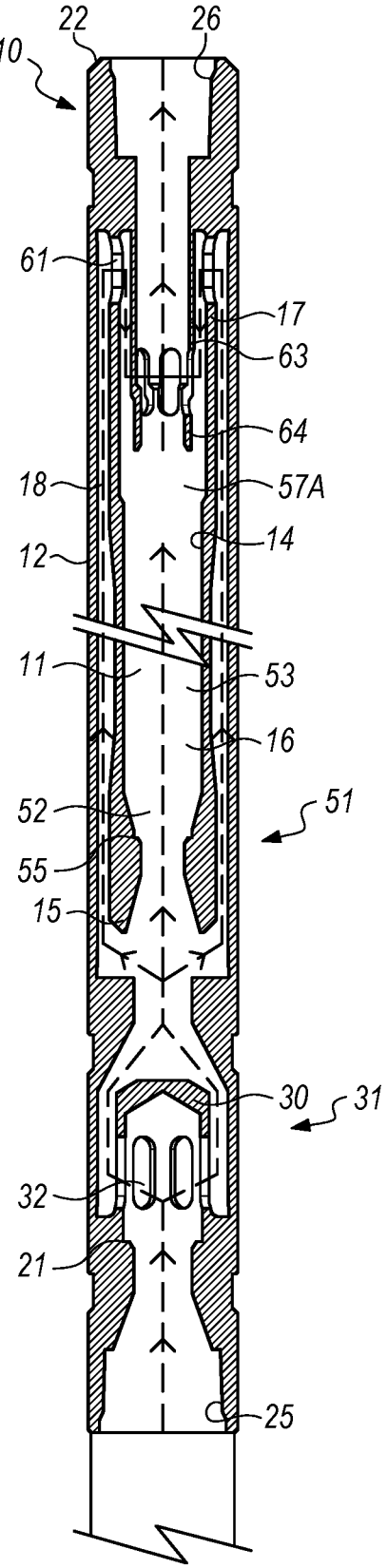
FIG. 21 is the cross-sectional elevation view of an embodiment of the sand fallback tool of FIGS. 19 and 20 after restoration of power to the submersible pump and resumption of fluid flow upwardly through the tool.

FIG. 21 is the cross-sectional elevation view of an embodiment of the sand fallback tool 10 of FIGS. 19 and 20 after restoration of power to the submersible pump (not shown) coupled to the distal connector 25 of the sand fallback tool 10 and resumption of fluid flow upwardly through the sand fallback tool 10. Upon restoration of the operation of the submersible pump, fluid pressure initially provides for restoration of fluid flow from the submersible pump (not shown), through the distal connector 25, through the holes 32 of the cage 30, through the annular passage 18, radially inwardly through the holes 61 adjacent to the proximal end 17 and in the tubular flow divider 14, downwardly along the tubular extension 63, radially inwardly to enter the distal end 64 of the tubular extension 63 and then to exit from the sand fallback tool 10 through the proximal connector 26. As flow through these structures occurs, the turbulence of the flow causes unsettling and fluidization of the column 59 of settled sand 57 (see FIG. 20) within the central passage 16. At first, small amounts of the settled sand 57 begin to leave the settled sand 57 column 59 in the central passage 16 and become entrained in the fluid flow emerging from the annular passage 18 and leaving the sand fallback tool 10 through the proximal connector 26. As the column lightens, fluid pressure against the flow stop member 54 of the proximal check valve 51 displaces the flow stop body 54 from the seat 55 and fluid begins to channel through the column 59 of settled sand 57 and flow around the flow stop member 54, thereby further entraining sand in the fluid flow exiting the sand fallback tool 10 at the proximal connector 26.

In embodiments of the sand fallback tool 10 of the present invention, the introduction of fluids into the chamber 11 through the distal connector 25 may introduce bubbles upon resumption of operation of the submersible pump coupled to the distal connector 25. The introduction of bubbles may enhance the agitation, unsettling and disturbing of an accumulated column 59 of settled sand 57 and thereby assist in the gradual removal of the accumulated column 59 of settled sand 57 from the chamber 11 of the sand fallback tool 10.

Components of embodiments of the sand fallback tool 10 of the present invention may vary in size, shape and structure to suit the application. For example, but not by way of limitation, the length, diameter and shape of the tubular flow divider 14, the tubular extension 63 and/or the distal check valve 31 may vary. Similarly, the number of apertures 56 of the tubular flow divider 14 and/or the apertures 41 providing fluid communication between the central passage 16 and the bypass annulus 19 may vary in size, location, number and distribution. Also, the size, shape and number of holes 61 in the tubular extension 63 and/or the holes 32 of the cage 30 may vary. The relative dimensions of components of the embodiments of the sand fallback tool 10 of the present invention shown in the appended drawings are merely for purposes of illustration and are not to be taken as limiting of the present invention. The size, shape and structure of components of embodiments of the sand fallback tool 10 of the present invention may be varied to optimize performance, durability, maintenance, reconditioning, repair and compatibility with standard tubulars and other tools.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

We claim:

1. A sand fallback tool, comprising:

an elongate outer tubular body having an axis, a proximal end with a proximal connector for coupling to a production string, a distal end with a distal connector for coupling to a submersible pump, and an elongate chamber within the outer tubular body surrounding the axis and disposed axially intermediate the proximal end and the distal end of the outer tubular body; and a tubular flow divider having a proximal end and a distal end, the tubular flow divider supported within the chamber of the outer tubular body in a position to surround the axis and to divide at least a portion of the chamber into a central passage and an annular passage disposed radially intermediate the flow passage divider and the outer tubular body, the central passage of the tubular flow divider being axially aligned with the proximal end of the outer tubular body to provide an unobstructed axial settling path;

wherein during interruptions in a power supply to the submersible pump, sand entrained in fluid residing in the production string will settle from the production string through the unobstructed axial settling path into the central passage of the tubular flow divider.

2. The sand fallback tool of claim 1, further comprising:

a tubular extender coupled to the proximal connector and extending along the axis into the proximal end of the tubular flow divider.

3. The sand fallback tool of claim 1, further comprising:

a distal check valve disposed within the chamber of the outer tubular body and axially intermediate a distal end of the tubular flow divider and the distal connector of the outer tubular body.

4. The sand fallback tool of claim 3, wherein the distal check valve includes:

a seat within the chamber proximal to the distal end of the outer tubular body, the seat surrounding a bore to receive fluid flow from a submersible pump coupled to the distal connector, the fluid flow entering the chamber of the outer tubular body through the distal connector of the outer tubular body; and a flow stop member shaped for sealed engagement with the seat of the distal check valve, the flow stop member captured within the chamber intermediate the seat and the distal end of the flow passage divider and movable within the chamber between a seated position in sealed engagement with the seat, to prevent fluid flow from the chamber of the outer tubular body through the distal connector, and an open position with the flow stop member displaced from the seat to permit fluid flow from the submersible pump coupled to the distal end of the outer tubular body into the chamber of the outer tubular body.

5. The sand fallback tool of claim 4, wherein the distal check valve further includes:

a cage surrounding the seat to limit a range of movement of the flow stop member relative to the seat.

6. The sand fallback tool of claim 1, further comprising:

a proximal check valve within the central passage of the tubular flow divider and proximal to the distal end of the tubular flow divider.

7. The sand fallback tool of claim 6, wherein the proximal check valve includes:

a seat within the central passage; and a flow stop member shaped for sealed engagement with the seat of the distal check valve, the flow stop member captured within the central passage intermediate the seat and the proximal end of the tubular flow divider, the flow stop member movable within the central passage between a seated position in sealed engagement with the seat and an open position with the flow stop member displaced from the seat to permit fluid flow from the submersible pump coupled to the distal end of the outer tubular body into the distal end of the tubular flow divider and through the central passage during operation of the submersible pump.

8. The sand fallback tool of claim 1, further comprising:

a necked portion of the central passage of the tubular flow divider proximal to the distal end of the tubular flow divider.

9. The sand fallback tool of claim 1, further comprising:

a necked portion of the central passage of the tubular flow divider proximal do the distal end of the tubular flow divider;

wherein the necked portion of the central passage promotes bridging of settled sand at the necked portion and subsequent accumulation of a column settled sand atop the bridged sand at the necked portion.

10. The sand fallback tool of claim 1, further comprising:

a resiliently deformable funnel member coupled to the proximal end of the tubular flow divider shaped as an upwardly expanding section of a cone, the resiliently deformable funnel member having an original configuration to guide settling sand entering the outer tubular body through the proximal connect into the central passage and a collapsed configuration to allow fluid flowing upwardly in the annular passage surrounding the tubular flow divider to flow radially inwardly from the annular passage to the proximal connector.

11. The sand fallback tool of claim 10, wherein the resiliently deformable funnel member comprises rubber.

12. The sand fallback tool of claim 1, wherein the tubular flow divider is supported from one of the proximal end of the tubular flow divider and the distal end of the tubular flow divider.

13. A sand fallback tool, comprising:

an elongate outer tubular body having a proximal end with a proximal connector, a distal end with a distal connector, an axis extending from the proximal connector to the distal connector, and an elongate chamber intermediate the proximal end and the distal end of the outer tubular body; and a tubular flow divider supported within the chamber to surround the axis and to divide at least a portion of the chamber into a central passage about the axis and an annular passage surrounding the tubular flow divider; and an unobstructed axial settling path from the proximal connector into the central passage to allow sand settling into the sand fallback tool through the proximal connector to move into the central passage of the tubular flow divider with the sand fallback tool with the axis being vertically aligned;

wherein during interruptions in a power supply to the submersible pump, sand entrained in fluid residing in a production string coupled to the proximal connector will settle from the production string through the unobstructed axial settling path into the central passage of the tubular flow divider.

14. The sand fallback tool of claim 13, further comprising:

a distal check valve disposed within the chamber and proximal to the distal connector, the distal check valve having a closed position to prevent fluid flow from the chamber through the distal connector and an open position to allow fluid flow from a submersible pump coupled to the distal connector into the chamber.

15. The sand fallback tool of claim 13, further comprising:

a proximal check valve disposed within the central passage, the proximal check valve having a closed position to prevent flow from a distal end of the central passage and an open position to allow fluid flow from the distal connector through the distal end of the central passage into the central passage.

16. The sand fallback tool of claim 13, further comprising:

a resiliently deformable funnel member coupled to a proximal end of the tubular flow divider, the funnel member having a relaxed configuration in which it guides settling sand entering the sand fallback tool through the proximal connector into the central passage and a collapsed configuration to allow fluid flowing within the annular passage from the distal connector towards the proximal connector to flow radially inwardly to the proximal connector.

17. The sand fallback tool of claim 16, wherein the funnel member is shaped as an upwardly expanding section of a cone.

18. The sand fallback tool of claim 17, wherein the funnel member comprises rubber.

19. The sand fallback tool of claim 13, wherein the tubular flow divider is supported within the chamber from one of the proximal end and the distal end.

20. The sand fallback tool of claim 13, further comprising a cage proximal to the distal connector.

* * * * *